US007698985B2

(12) United States Patent
Tapp et al.

(10) Patent No.: US 7,698,985 B2
(45) Date of Patent: Apr. 20, 2010

(54) RAPIDLY INSTALLABLE ENERGY BARRIER SYSTEM

(75) Inventors: Robert Timothy Tapp, Washington, DC (US); William M. Keys, Hume, VA (US)

(73) Assignee: Côlt Rapip Mat LLC, West Hartford, CT (US)

( * ) Notice: Subject to any disclaimer, the term of this patent is extended or adjusted under 35 U.S.C. 154(b) by 216 days.

(21) Appl. No.: 11/614,592

(22) Filed: Dec. 21, 2006

(65) Prior Publication Data

US 2007/0180981 A1 Aug. 9, 2007

Related U.S. Application Data

(60) Provisional application No. 60/753,380, filed on Dec. 21, 2005.

(51) Int. Cl.
*F41H 5/04* (2006.01)
*F41H 5/24* (2006.01)

(52) U.S. Cl. ..... 89/36.02; 89/36.04; 89/36.08

(58) Field of Classification Search ..... 89/36.02, 89/36.08, 36.04
See application file for complete search history.

(56) References Cited

U.S. PATENT DOCUMENTS

| | | | | |
|---|---|---|---|---|
| 3,649,426 | A * | 3/1972 | Gates, Jr. | 428/68 |
| 4,498,677 | A | 2/1985 | Dapkus | 273/380 |
| 4,716,810 | A * | 1/1988 | DeGuvera | 89/36.02 |
| 5,293,806 | A * | 3/1994 | Gonzalez | 89/36.03 |
| 5,413,027 | A | 5/1995 | Mixon | 89/36.17 |
| 5,723,807 | A | 3/1998 | Kuhn, II | 89/36.02 |
| 7,549,366 | B2 * | 6/2009 | Park et al. | 89/36.02 |
| 2003/0221547 | A1 * | 12/2003 | Peretz | 89/36.02 |
| 2005/0188825 | A1 | 9/2005 | Sharpe et al. | 86/50 |
| 2005/0242093 | A1 | 11/2005 | Sharpe et al. | 220/62.11 |
| 2006/0065111 | A1 | 3/2006 | Henry | 89/36.02 |

* cited by examiner

*Primary Examiner*—Stephen M Johnson
(74) *Attorney, Agent, or Firm*—Perman & Green, LLP

(57) ABSTRACT

A modular energy barrier system has at least one energy barrier module. The module has a substantially rigid casing and an energy absorbing filler material. The casing has at least one frangible side. The filler material is disposed inside the casing. The casing is adapted to be connected to a base support so that the module is interposed between the base structure and an energy source and the at least one frangible side of the casing is oriented to face energy released by the energy source.

5 Claims, 15 Drawing Sheets

RAPIDLY INSTALLABLE ENERGY BARRIER SYSTEM

CROSS-REFERENCE TO RELATED APPLICATION(S)

This application claims the benefit of U.S. Provisional Application No. 60/753,380 filed Dec. 21, 2005 which is incorporated by reference herein in its entirety.

BACKGROUND

1. Field of the Exemplary Embodiments

The exemplary embodiments described herein relate to an energy barrier system and, more particularly, to an energy barrier system that may be rapidly erected and redeployed.

2. Brief Description of Related Developments

Present temporary deployment protection systems used for example, to shield structures from blasts or detonations are primarily in the form of sandbags. Though long proven to be very effective against blast effects, the sandbags are filled with sand at the time of use and a considerable amount of time and manpower is required to fill the sandbags. Once filled the sandbags are heavy and cumbersome. In addition, large numbers of sandbags are needed to achieve desired absorber effects against blasts, and even small structures employ significant number of sandbags. Further, sandbags have little effect in suppressing flash that may accompany blasts. Flash absorber systems are known, but these systems are fragile, readily susceptible to damage which is an encumbrance to rapid installation of such a system and limits the duration areas where such a system may be used.

SUMMARY OF THE EXEMPLARY EMBODIMENTS

According to one exemplary embodiment a modular energy barrier system is provided. The system has at least one energy barrier module. The module has a substantially rigid casing and an energy absorbing filler material. The casing has at least one frangible side. The filler material is disposed inside the casing. The casing is adapted to be connected to a base support so that the module is interposed between the base structure and an energy source and the at least one frangible side of the casing is oriented to face energy released by the energy source.

According to another embodiment, a modular energy absorber system is provided. The system includes at least one module. The module includes a frangible front panel, an anti-ballistic rear panel connected to the front panel so that the front and rear panels form a substantially rigid structure that forms a chamber between front and rear panels. A filler material is positioned into the chamber.

In accordance with another exemplary embodiment, a modular energy barrier system is provided. The system includes at least one module. The module includes a frangible front panel, an anti-ballistic rear panel connected to the front panel so that the front and rear panels form a substantially rigid structure that forms a chamber between the front and rear panels. A filler material is positioned into the chamber. The system also includes a supporting structure that is capable of supporting a plurality of the modules. Moreover, the system includes a mounting system that is capable of attaching the modules to the supporting structure. The modules are capable of being quickly attached or detached to/from the supporting structure and the supporting structure is capable of being quickly assembled or disassembled enabling the rapid deployment or redeployment of the energy barrier system.

In accordance with another exemplary embodiment, a modular barrier system kit is provided. The system includes at least one module. The module includes a frangible front panel, an anti-ballistic rear panel connected to the front panel so that the front and rear panels form a substantially rigid structure that forms a chamber between the front and rear panels. A plurality of filler material packages are positioned into the chamber. The system also includes a mounting system that is capable of attaching the modules to the supporting structure. The modules are capable of being divided into a plurality of sub-chambers and each sub-chamber may have a plurality of filler material packages positioned and oriented in each sub-chamber.

In accordance with another exemplary embodiment, method of deploying and redeploying a modular energy barrier system is provided. The method includes providing at a first geographic location at least one energy absorbing module. The module includes a frangible front panel, an anti-ballistic rear panel connected to the front panel so that the front and rear panels form a substantially rigid structure that forms a chamber between the front and rear panels. A filler material is positioned into the chamber. The method also includes providing at a first geographic location a supporting structure that is capable of support of the energy absorbing modules and a mount system for connecting the modules to the supporting structure. Moreover, the method includes attaching at the first location the modules to the supporting structure using the mount system.

BRIEF DESCRIPTION OF THE DRAWINGS

The foregoing aspects and other features of the present invention are explained in the following description, taken in connection with the accompanying drawings, wherein.

DETAILED DESCRIPTION OF THE EMBODIMENT(S)

Figure 1:
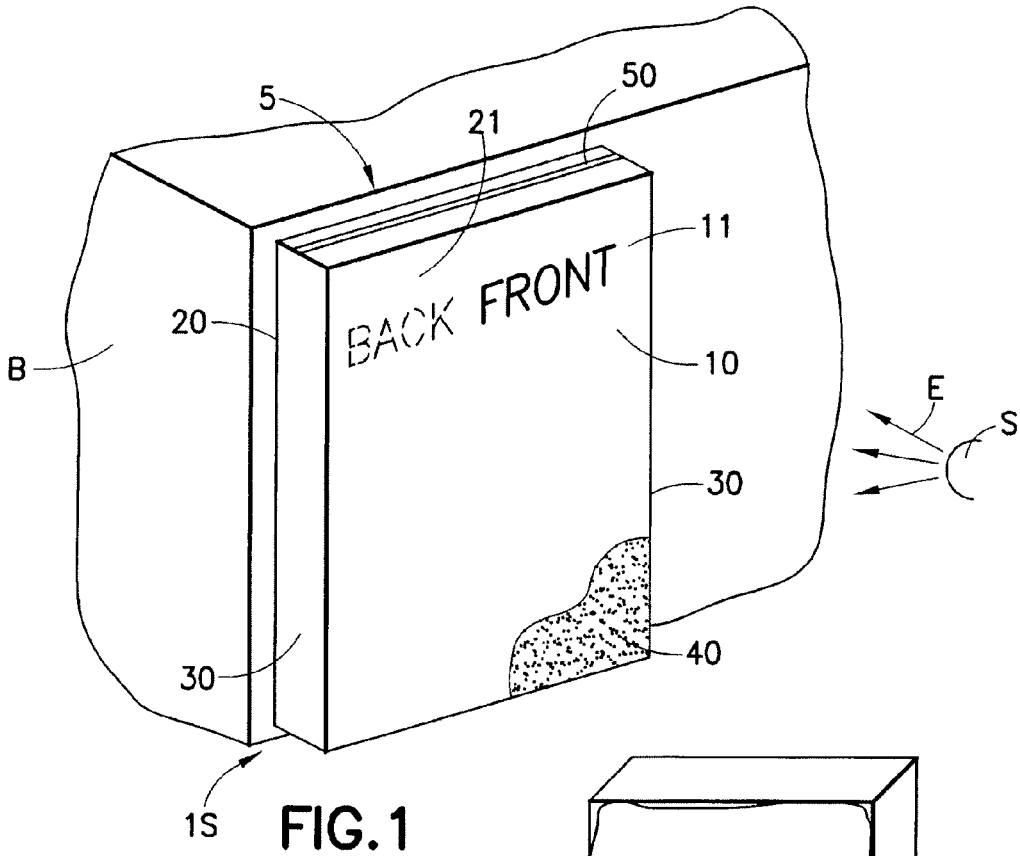
FIG. 1 is a perspective view of a panel in accordance with an exemplary embodiment.

Referring to FIG. 1 there is shown a schematic representation of a barrier system 1S, incorporating features in accordance with an exemplary embodiment, and a base structure B. The base structure, as will be described in greater detail below, may be any desired base structure, and is illustrated schematically in FIG. 1 as a structure of desired vertical height (for example a wall such as an outer wall of a building, raised beam or earth work or any other suitable support) . The barrier system 1S may be modular, with a number of modules or panels (described in greater detail below) that may be positioned or connected to the base structure B. When connected to or positioned against the base structure, the system 1S may form an energy barrier to energy released and directed towards the base structure from a source. The source S is illustrated schematically in FIG. 1, and may be of any desired type. The energy released (the direction of propagation—is indicated by arrows E in FIG. 1) may have one or more thermal, flash, pressure and ballistic or kinetic fragmentation components. The system 1S is interposed between the energy source S and base structure B and addresses the energy released by the source and directed towards the base structure prior to the energy reaching the base structure and ameliorates the energy reaching the base structure to levels that will not cause failure of the base structure. Although the present invention will be described with reference to the exemplary embodiments shown in the drawings and described below, it should be understood that the present invention can be embodied in many alternate forms of embodiments. In addition, any suitable size, shape or type of elements or materials could be used.

Figure 2:
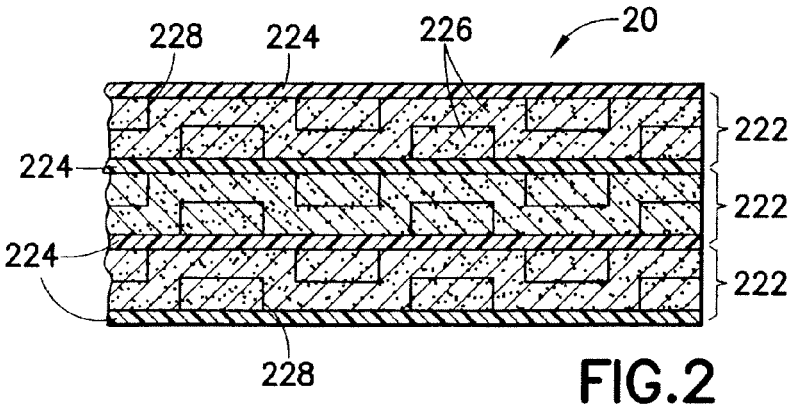
FIG. 2 is a cross-sectional view of a portion of the panel of FIG. 1 in accordance with an exemplary embodiment.

Referring to FIGS. 1 and 2, a section or panel 5 of the energy barrier system in accordance with an exemplary embodiment is shown. The section includes a front portion 10, a back portion 20, side portions 30 and a filler material 40.

The front portion 10 of the panel is constructed of a frangible material such as for example, fiberglass impregnated with resin as will be described below. The front portion 10 may be, for example one-eighth-inch thick and in the exemplary embodiment is generally thinner than back portion 20. In alternate embodiments, the front portion 10 may be any suitable thickness. In other alternate embodiments the front portion 10 may be constructed of, for example, ceramic, plastic, polyethylene, polyvinyl chloride, a composite polymer, a carbon fiber, glass or any other suitable frangible material. As will be discussed in greater detail below, the thickness, and/or other frangible characteristics of frangible front portion of the panel may be established as desired so that premature fracture of the front portion does not occur.

In the exemplary embodiment shown, the back portion 20 of the panel may be fracture resistant. The back portion 20 of the panel may be made of for example a fiberglass-reinforced polyester membrane. The composition of the back portion may be similar to the Rapid Mat™ fiber glass mats available from Colt Rapid Mat LLC. Suitable examples of fiberglass-reinforced polyester membrane are described in U.S. Pat. Nos. 4,404,244 and 4,629,358, which are incorporated herein by reference in their entirety. FIG. 2 shows a portion of the back portion membrane. This fiberglass-reinforced membrane may be formed of several layers of fiberglass matting such as for example, three layers. In alternate embodiments, any suitable number of layers may be used to form the back portion 20 of the panel. In alternate embodiments, the back portion 20 may be constructed of any suitable material. As shown in FIG. 2, and as will be discussed in greater detail below, each ply or layer 222 of fiberglass matting may be made from chopped fiberglass strands 224 chemically bonded to a woven roving 226, with all voids (i.e. 28, etc.) impregnated with polyester resin. The weave 226 may be for example aramid reinforced fiberglass or any other suitable material including a generally aramid fiber weave. The chopped strands may also be reinforced with aramid fibers if desired. In the exemplary embodiment, the layers are substantially similar to each other. In alternate embodiments different layers may be used, such as one layer with aramid reinforcement and others without, in order to provide the composite back portion with desired gross physical properties (e.g. tensile strength, shear strength, etc.) though the front and back portions of the panel are shown as having a substantially uniform thickness and composition in the exemplary embodiment, in alternate embodiments, different areas of the front or back portions may have different thicknesses or material compositions to provide tailored structural properties to the panel or panel portions. For example, areas of the panel portions interfacing with panel attachments, or positioned in locations where certain static or dynamic loads are expected to be imported onto the panel may be of greater thickness or reinforced with desired materials such as plastic shapes, etc.

Figure 6:
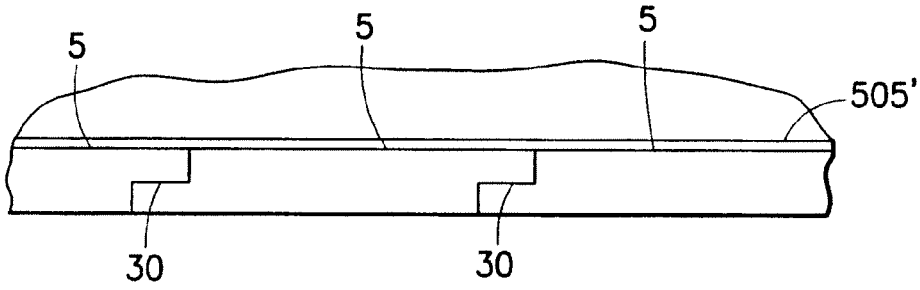
FIG. 6 shows plan view of a portion of a barrier of panels in accordance with another exemplary embodiment.

The side portions 30 may also be constructed of a fiberglass material similar to the material used for the front portion 10. Side portions 30 are shown as positioned on lateral sides for example purposes but may also be located on top/bottom of the panel. The side portions may be formed as a laminate in the same manner as either the front or back portions 10, 20 as will be described below. In alternate embodiments, the side portions 30 may be constructed of any suitable material such as for example, ceramic, plastic, a composite polymer or carbon fiber. In other alternate embodiments, the side portions may be formed by injection molding or any other suitable process. As will be described in greater detail below the side portions 30 may be formed separate from the front and back portions 10, 20. The panel side portions 30 may also be formed as a lap joint having interlocking or overlapping edges as shown in FIG. 6. The interlocking edges may provide continuous protection along the length of the wall 510 and help eliminate any gaps that may exist between the installed panels.

The filler material 40 may be any suitable energy absorbing or attenuating material, for example, BlastWrap™ as manufactured by Blastgard® International, Inc. BlastWrap™ includes an attenuating filler material that may include perlite, a volcanic glass bead, or other suitable two phase material and a blend of extinguishants. The filler material may be lightweight with a real density of for example, approximately 0.6 pounds per square foot at one inch thick. In alternate embodiments, any other suitable material, such as for example suitable synthetic materials or sand, may be used as the filler material. The filler material may be in loose form, or may be packages in a suitable container, such plastic sheeting or wrap. Filler material packages may be of desired dimensions to fit and be stably held in between the outer portions 10, 20, 30 of the panel 5 as will be described below.

Figure 3:
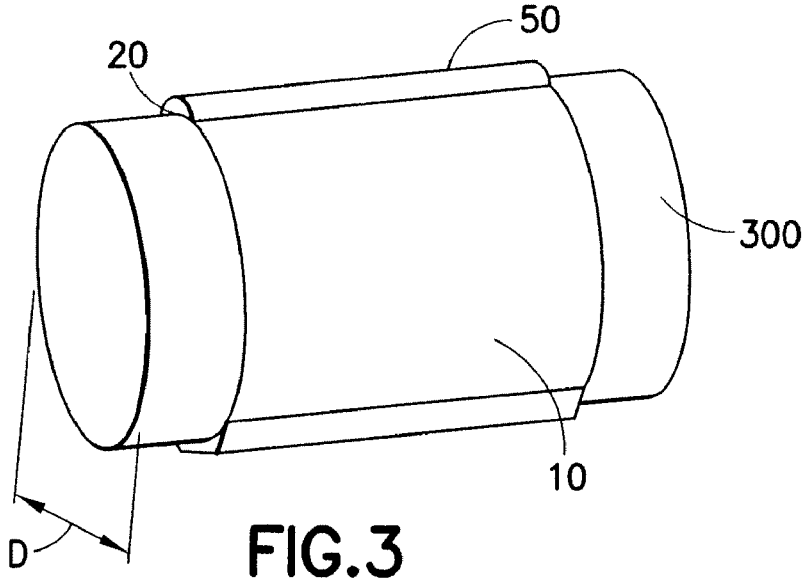
FIG. 3 illustrates a mold used for forming a portion of the protective panel of FIG. 1 in accordance with an exemplary embodiment.
Figure 4A:
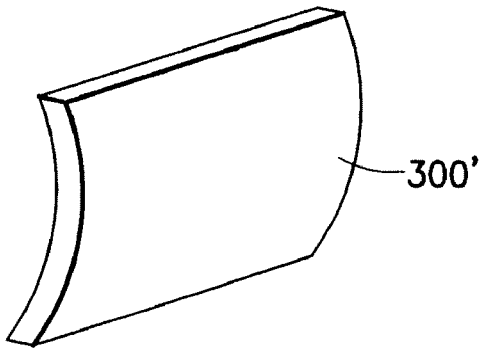
FIGS. 4A and 4B illustrate molds used for forming a portion of the protective panel of FIG. 1 in accordance with other exemplary embodiments.
Figure 4B:
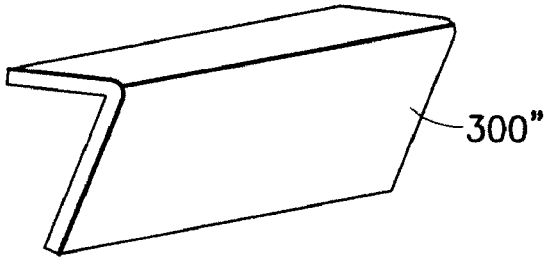

Referring also to FI G. 3, a method of constructing the panel 5 according to an exemplary embodiment will now be described. The front portion 10 and the back portion 20 of the panel 5 may be formed using an inside mold 300 and when completed the front and back portions 10, 20 form a tube, shell or sleeve having open ends that is slid off of the mold. The mold may have any suitable cross section, a substantially rectangular cross section is shown in FIG. 3 for example purposes, to form a panel 5 of desired shape. The mold 300 in the exemplary embodiment shown in FIG. 3 may be used to form panel 5 as shown in FIG. 1. In an alternate embodiment, the mold may be configured so that the three sides of the front and rear portions 10, 20 may be joined together to form a pocket having one open end rather than a sleeve. FIGS. 4A and 4B respectively show the molds 300', 300" used for forming panels of other shapes in accordance with other exemplary embodiments the mold 300' may be configured to form a panel (as may be realized the resultant panel shape conforms substantially to the mold shape shown) to wrap around a curved structure, such as a door of a vehicle; the mold 300" may be configured to form a panel to wrap around an edge or corner of a wall or frame of a vehicle. The mold may also be formed to form projecting shapes or re-entrant shapes or recesses in either the front or back portions of the panel. For compound shapes, the mold may be a sand cast mold sprayed with a release agent or otherwise coated to prevent the sand from contacting the fiberglass and/or resin. The sand cast mold may be taken out of the sleeve through a vibratory process that breaks up the sand mold or through any other suitable process. The cast mold may be a base mold used to generate an intermediate fiberglass or plastic or ceramic mold used in actual formation of the panels. The intermediate mold may be coated to prevent adhesion between overlaid panel materials and mold during formation of the panel. The mold may produce a sleeve having a depth "D" of for example, three inches. In alternate embodiments, the mold may be configured to produce a sleeve having any suitable depth.

During the construction of the panel, a thermosetting low pressure, wet layup type polyester resin may be used to construct both the front and back portions 10, 20 of the panel 5. In alternate embodiments any suitable type of resin may be used. The front portion 10 of the panel 5 may be formed by layers of fiberglass cloth placed on a side of the mold 300. As each layer of fiberglass is applied to the mold 300 the resin is sprayed over the fiberglass until it is saturated in a manner substantially similar to that described below for the back portion 20 of the panel 5. Any suitable fiberglass cloth may be used to form the front portion 10 of the panel. In alternate embodiments, preformed panels made of, for example, plastic, polyethylene, or polyvinyl chloride or any other suitable frangible material may be applied to the mold or fitted and joined to the cured back portion 20 of the panel with an epoxy or any suitable adhesive. The fiberglass may be added in layers to create any suitable thickness.

In the exemplary embodiment, the back portion 20 may be built up in stages by alternately laying out a single ply 222 (see also FIG. 2) of material and applying polyester resin until the fiberglass strands are saturated and all spaces and voids 228 in the weave and between layers are filled with the polyester resin. As described before, in the exemplary embodiment the back portion 20 may be generally thicker than the front portion 10 as will be described in greater detail below. The mat layers 222 as shown in FIG. 2, may have the woven roving side 226 upward and the layers placed in alternating directions with adjacent strips of fiberglass matting overlapping, for example, six to eighteen inches. Approximately 2.16 gallons of polyester resin may be used for example for each square yard of membrane cover. The polyester resin mixture may be readily applied to each ply of the fiberglass matting for example with a two-component spray gun that mixes at the nozzle. The polyester resin may be applied in a uniformly distributed spray pattern for example at a rate of about 0.8 to 0.9-lb of resin per square-foot of fiberglass matting per layer, such that the fiberglass matting is thoroughly wet-out (saturated), with care being exercised to avoid application of too much resin on the fiberglass surface that could later craze. The resin spray should be directed as perpendicular as possible to the matting to increase penetration of the resin. A serrated roller may be used for example to expel any trapped air and to densify the laminate. The process may be repeated until a fiberglass reinforced polyester membrane cover of any suitable thickness, such as for example one-half-inch thick, is constructed.

In the exemplary embodiment the front portion 10 and the rear portion 20 of the panel 5 may be joined at a seam 50. The seam is shown as being located at the edges for example, but may be positioned on the front or back of the panel. The seam 50 may be formed by laminating, lapping or folding the edges of the front and back portions 10, 20 over one another. The resin is sprayed over each fold so that the resin fully saturates the seam so that the front and back portions 10, 20 of the panel cannot be separated. Metal, plastic or other suitable material inserts of desired strength may be inserted into the folds of the seam to give the seam greater structural integrity so that the seam 50 may be used as an interface for installing the panel 5 to an object as will be described below. In alternate embodiments, any suitable method or process for joining the front and back portions 10, 20 of the panel 5 together may be used.

A suitable example of the makeup of the back portion is cured resin used in conjunction with 4020 style fiberglass (4020 fiberglass matting includes about 40 oz. per square-yard woven roving 226 and about 2 oz. per square-foot chopped strand 224 fiberglass fibers. Both the woven roving and chopped strand being of type E fiberglass.) at about a 60:40 resin to glass ratio to produce a laminate having the following minimum mechanical properties:

Flexural Strength (ASTM D790-66): about 28,800 psi

Tensile Strength (ASTM D638-68): about 17,000 psi

Elastic Modulus, Tension (ASTM D638-68): about $1.5\times10^6$ psi

Barcol Hardness, #934: about 55

In alternate embodiments any suitable resin to glass ratio or type of fiberglass may be used. A suitable polyester resin has been found to be PPG Industries resin designated PS50338, which contains approximately 40% styrene monomer. This polyester resin is activated by the following catalyst system:

Catalyst: Cumene Hydroperoxide

Promoter: 1:1 by volume N,N-Dimethyl-p-Toluidine and Vanadium Trineodecanoate

In one suitable example catalyst and promoter concentrations may vary between about 1.2 to about 0.31 (catalyst) and about 0.3 to about 0.08 (promoter) parts per hundred resin depending upon ambient temperature.

The front and back portions 10, 20 of the panel 5 are cured at suitable pressures and temperatures and the formed panel shell is removed from the mold 300. In alternate embodiments, the front and back portions 10, 20 (i.e. the sleeve) of the panel 5 may be a plastic, polyethylene, or polyvinyl chloride molding formed, for example by blow molding. In other alternate embodiments, the sleeve may be formed of any suitable material by any suitable process. In still other alternate embodiments, to reduce the weight and cost of the panel, the resin can be filled with hollow inorganic silica microspheres up to, for example, about eight percent by weight of resin. In another alternate embodiment, the resin can be filled with any suitable hollow microsphere in any suitable percentage by weight of resin.

The filler material 40 may be inserted into the sleeve through one of the open ends. As noted before, the filler material may be packages in desired size and shape to substantially conform to the interior of the sleeve. To assist in filling the sleeve with the filler material 40, one side portion 30 of the panel may be attached to the sleeve as will be described below. The side portions 30 of the panel 5 are in effect caps. The side portions 30 may be attached to the sleeve by placing the side portions 30 over the open ends of the sleeve and securing them to the sleeve using an epoxy resin or any other suitable adhesive or chemical bonding agent. In alternate embodiments, the side portions 30 may be affixed to the open ends of the sleeve by, for example, mechanical fasteners. The finished and assembled panels 5 may be easily packed and transported within a standard twenty foot long shipping container and may be provided having, for example, a height of four feet, a width of three feet and a depth of three inches. In alternate embodiments, the panels may be provided having any suitable dimensions to be stably held and shipped in any suitable shipping containers. When assembled, the panel 5 may weigh approximately twenty-five pounds.

Figure 1A:
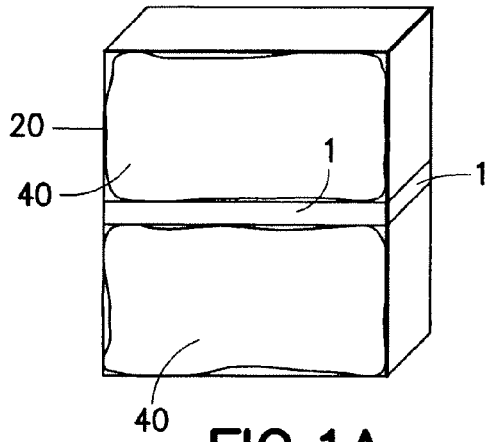

In the embodiment shown in FIG. 1A, two filler material packages 40 are shown for example purposes only, and in alternate embodiments the filler material inside the shell may be disposed in any desired number of packages. The placement of the filler material packages inside the panel shown in FIG. 1A is exemplary, and in alternate embodiments packages of filler material may be placed so that interfaces between packages may be positioned and oriented as desired inside the panel 5. The filler material packages and the filler material contained in the packages may vary in size and amount respectively. The filler material packages may be positioned and oriented inside panel 5 to achieve a desired orientation polarity. The orientation polarity may be distinctly marked on the front portion 10 or/and the back portion 20. The Front marking 11 on the front portion of the panel 5 and Back marking 21 on the back portion 20 of panel 5 is for example purposes only, and any alternate suitable marking may be used. As may be realized, the filler material 40 substantially fills the interior of the panel 5. In alternate embodiments, the filler material may be placed in loose form inside the shell. In other, alternate embodiments the energy absorbing or attenuating may be included in a support and distribution matrix, such as a gel or foam that is placed in the interior of panel 5.

In the exemplary embodiment the surface of the front portion 10, the rear portion 20 and the side portion 30 of the panel 5 may be treated for any desired ornamentation. The surface treatment may include texturing and painting the surface. The treated panels may be used in energy absorbing applications where the ornamentation of panel 5 is desired. The panel 5 may be treated to appear like a brick, stucco, wood, concrete or any other suitable textures or colors.

In the exemplary embodiments, the panel 5 may have a frangible seam 1 that divides the panel 5 into separate sub-chambers. There may be any number of seams 1 and the seams may be in any orientation. Moreover, there may be any number of sub-chamber shapes realized from a single panel 5. The filler material packages 40 are positioned or oriented in the sub-chambers such that the filler material packages do not overlap a seam 1. The panel 5 may be separated along the seam 1 without fracturing or tearing the filler material packages 40 encapsulated inside the sub-chambers.

Figure 5:
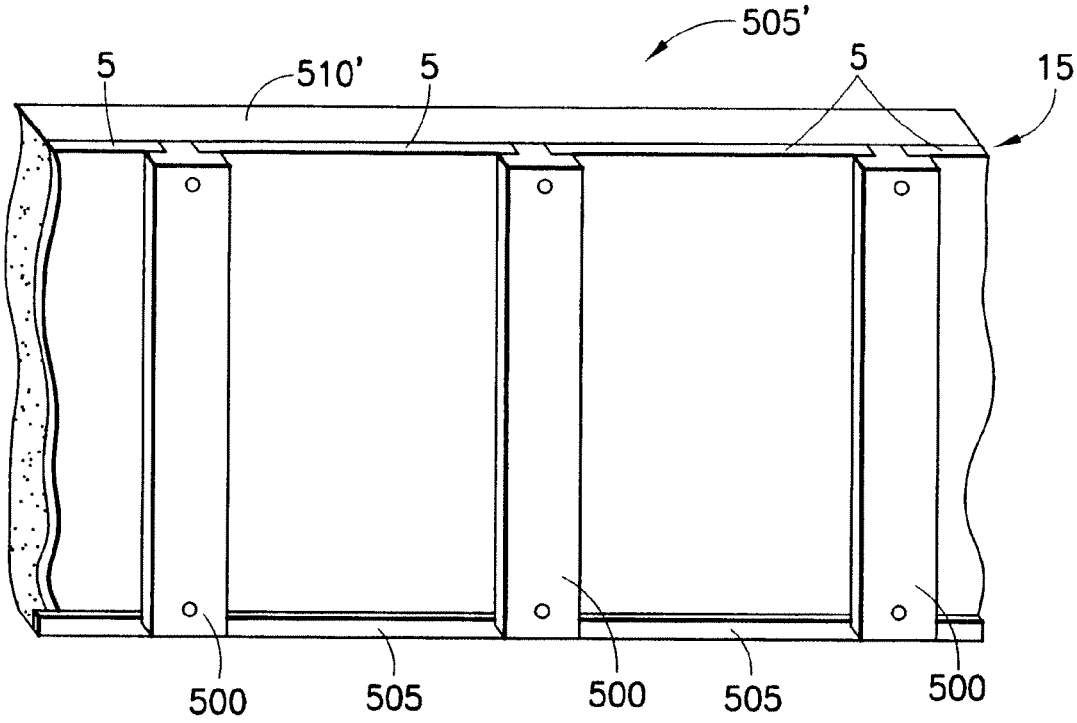
FIG. 5 is a partial perspective view of a system in accordance with an exemplary embodiment.
Figure 10:
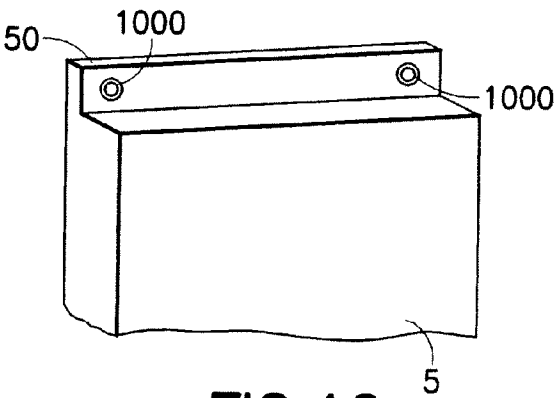
FIG. 10 shows a partial panel in accordance with yet another exemplary embodiment.
Figure 11:
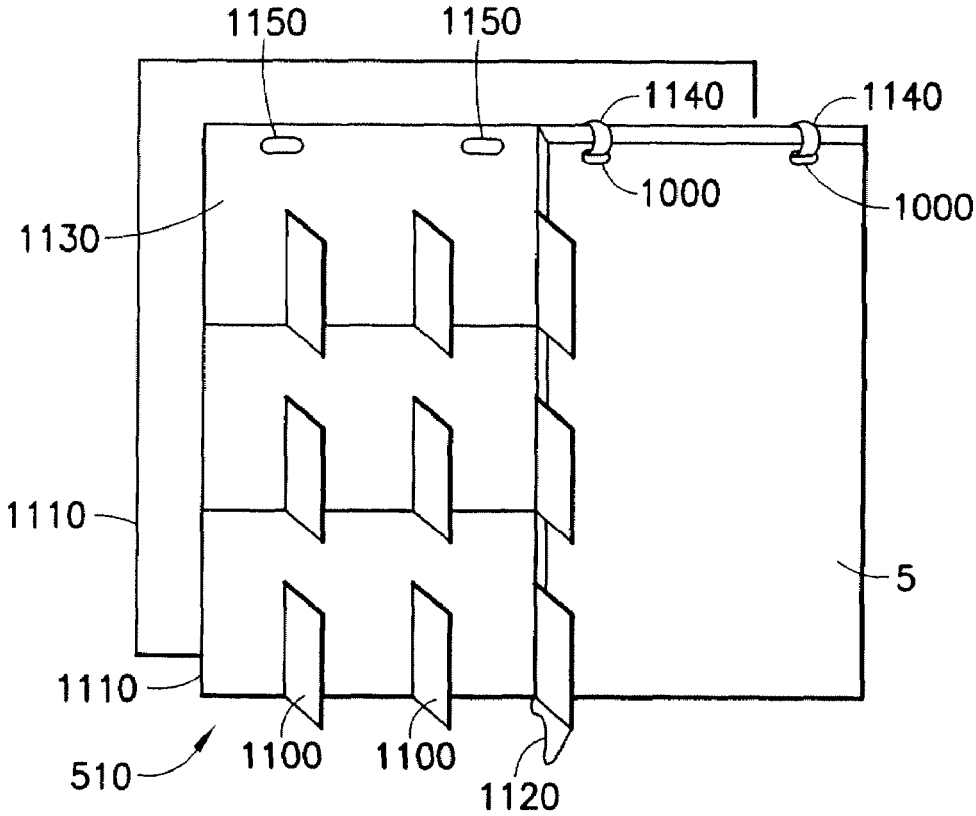
FIG. 11 is a perspective view that shows a system in accordance with still another exemplary embodiment and a structure.

Referring now to FIGS. 5-7, 8A, 8B, 10 and 11, in the exemplary embodiment the panel 5 may be part of a energy barrier system 15 on, for example, walls or any structural surface. FIG. 5 shows a rapid deployment structural system 505' which incorporates energy barrier system 15 in accordance with an exemplary embodiment, structural system 505' is a modular system generally having a base structure such as wall 510', and including barrier system 15. The rapid deployment wall 510 may be a modular grid similar to, for example, the "Rapid Deployment Fortification Wall" manufactured by Geocell Systems Inc. As can be seen in FIG. 11, the wall 510 may be formed of numerous cross members 1100, 1110 that interlock to form the rapid deployment wall 510. The grid may be collapsible when hollow and easily expanded and erected. The grid may be filled with any suitable filler material available at the erection site, such as sand. The panels 5 of barrier system 15 may be self-standing against the rapid deployment wall. For example, the panels may have lap joints 30 and be assembled as shown in FIG. 6. The barrier formed by the lapped panels may be free standing and placed to contact the surface of the wall 505.

Figure 17A:
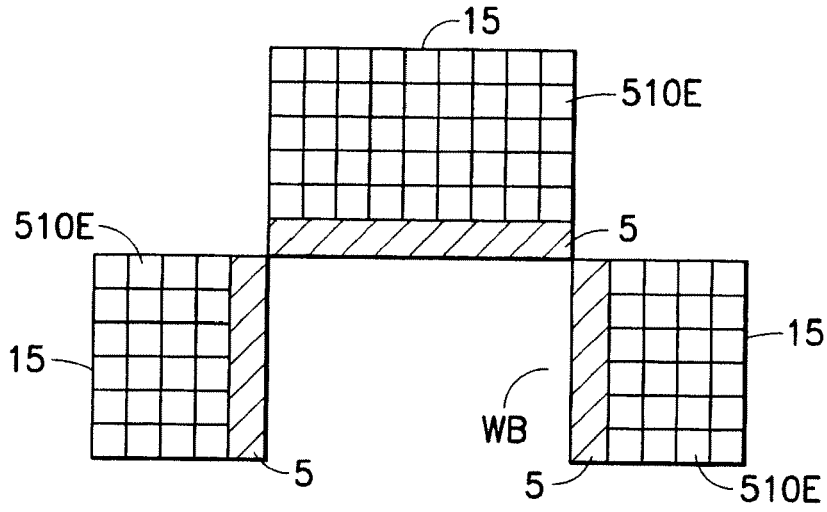
FIGS. 17A-17B are top plan views of the system in accordance with yet another exemplary embodiment.
Figure 17B:
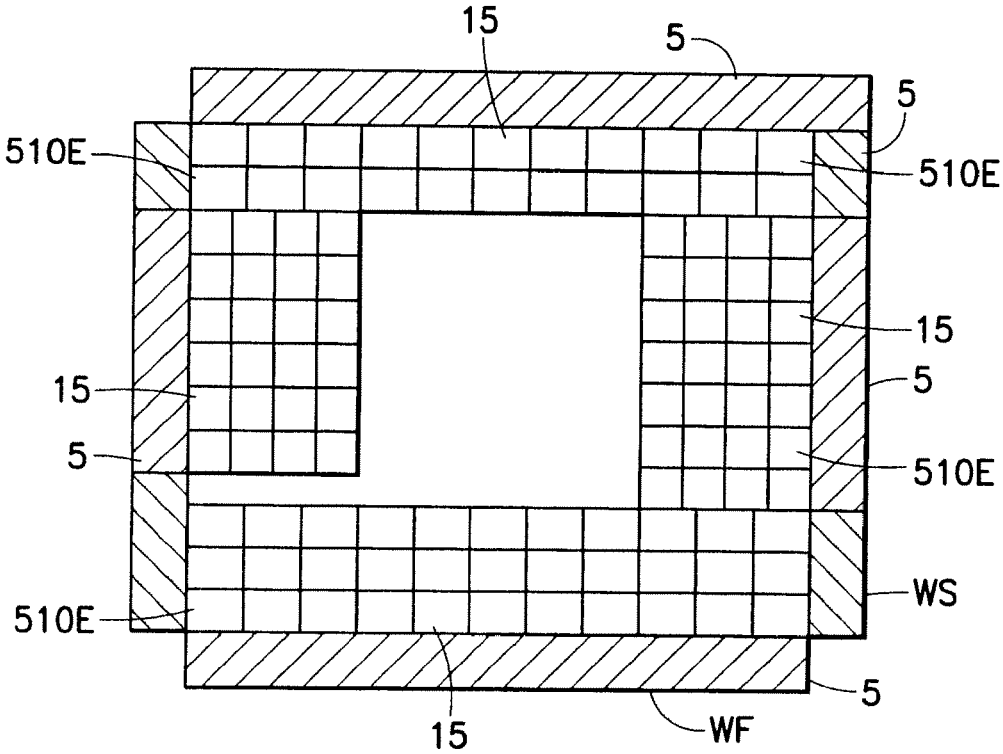

As can be seen in FIGS. 17A and 17B multiple barrier systems 15 can be arranged to provide a barrier perimeter of any desired shape, for example FIG. 17A has a "U" shape and FIG. 17B has a rectangular shape. The "U" shaped and rectangular shaped barrier systems 15 are only examples and any shape may be constructed with any number of barrier systems 15. Additionally, the panels 5 may be attached to the front wall WF or the back wall WB of the barrier system 15. The panels 5 may also be attached to the side wall WS to provide compete perimeter barrier protection.

Figure 12A:
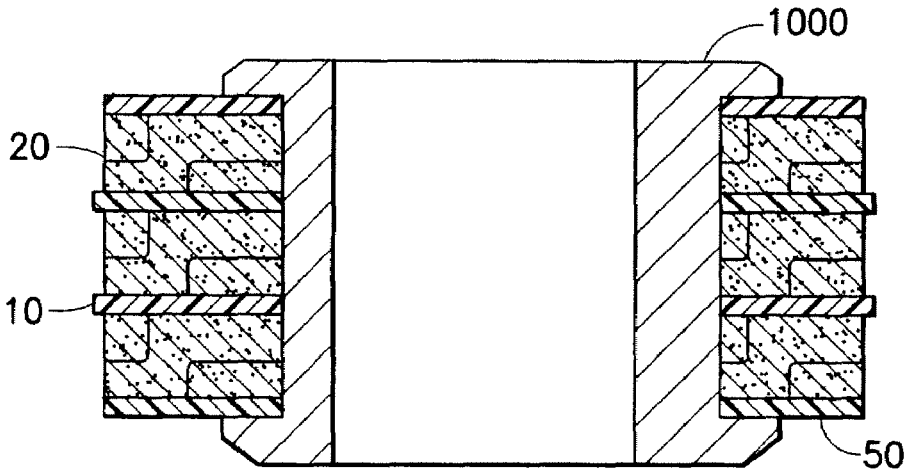
FIGS. 12A-12C are cross-sectional views respectively showing different configurations of attachment points of a panel.
Figure 12B:
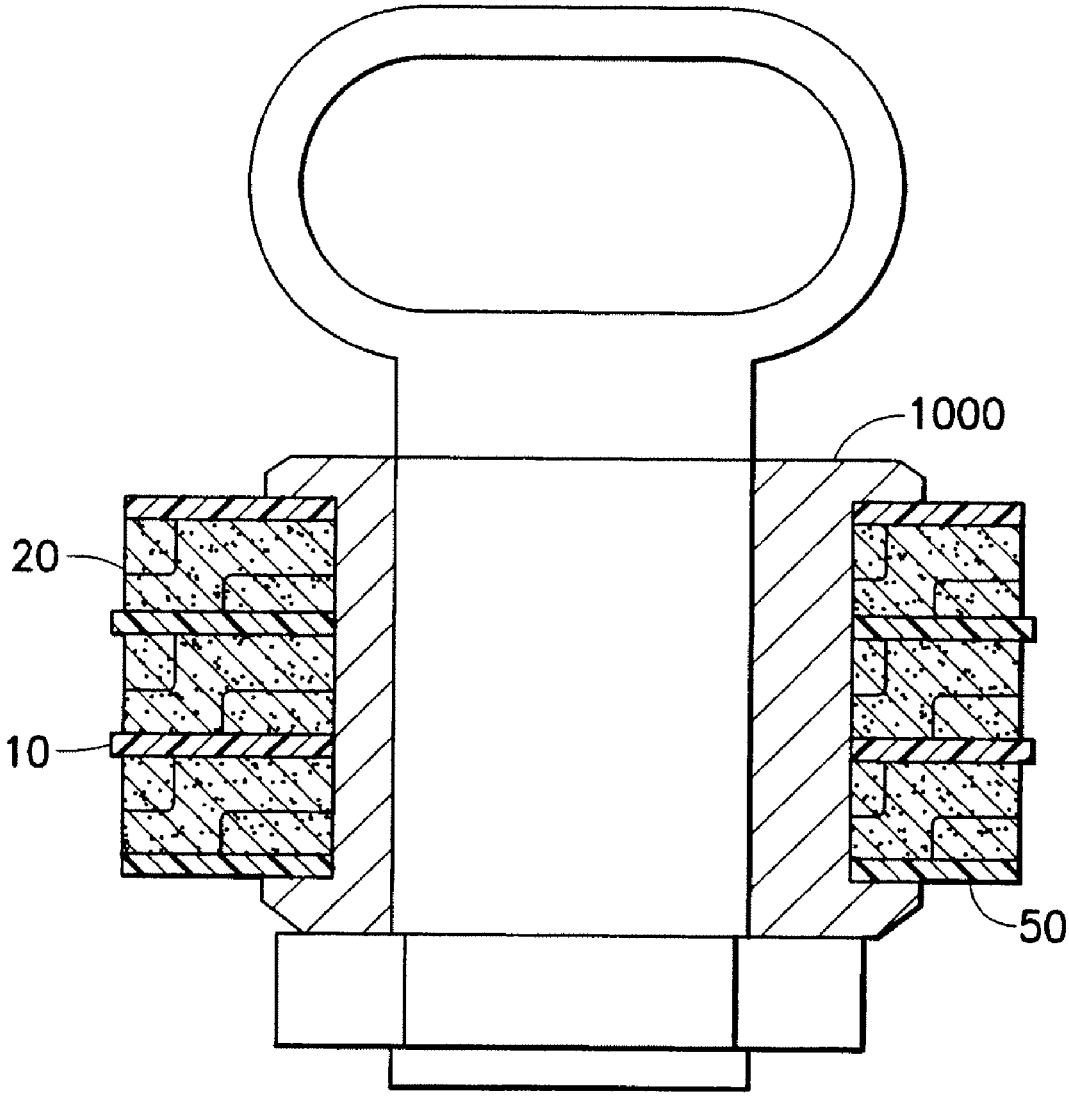
Figure 12C:
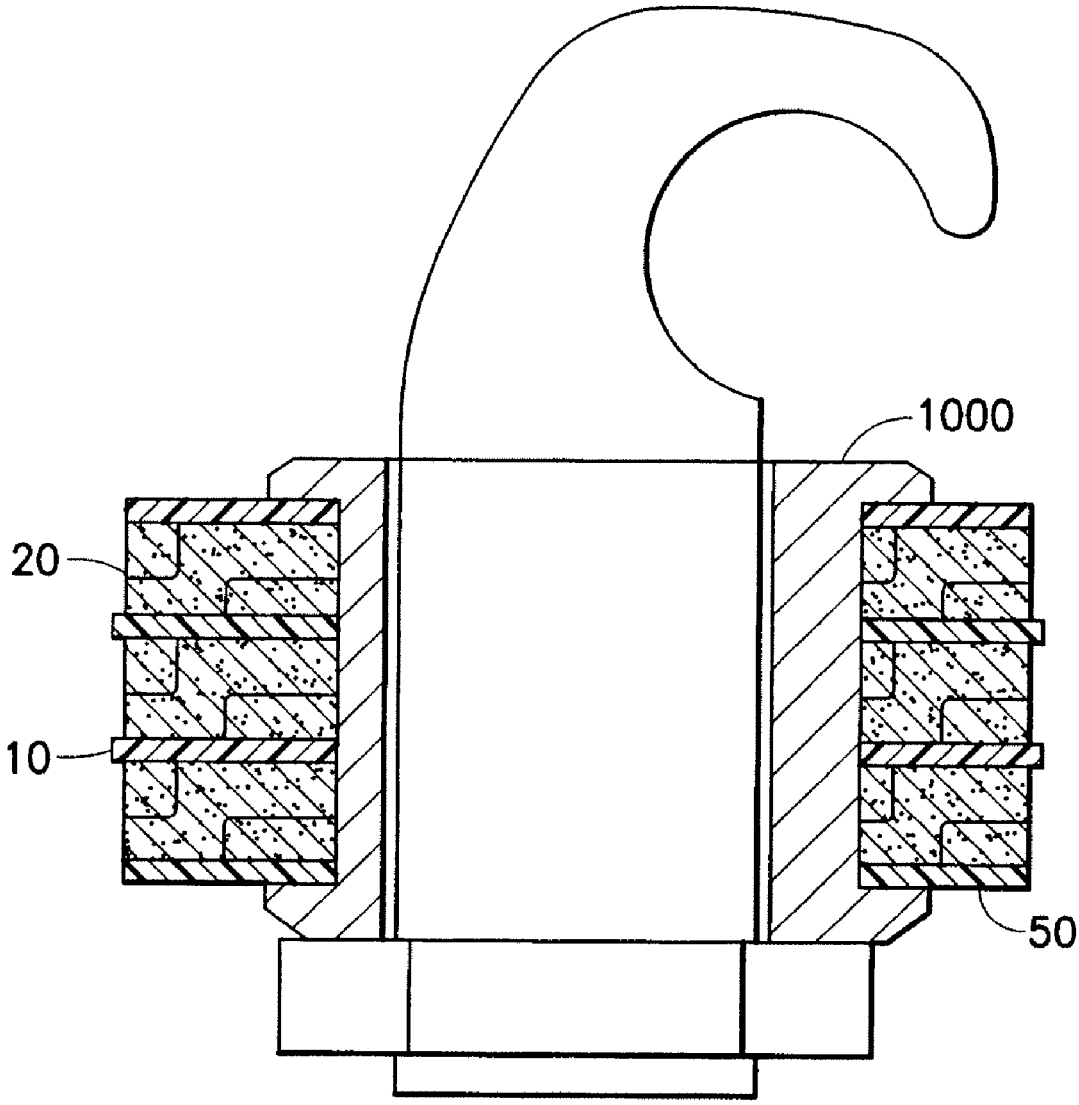

The barrier system 15 may also include an attachment or mounting system for attaching the panels 5 to the rapid deployment wall directly. To attach the panel 5 to the wall 510, the cross member extensions 1120 (see FIG. 11) may be folded flat against the surface 1130 of the wall 510. As can be seen in FIG. 10, in the exemplary embodiment the panels may be formed so the seam 50 forms a mounting point for the panel 5. The panel 5 may have been formed with a reinforcing metal bar, or other suitable reinforcing material, as described above, within the seam capable of distributing the support loads from the panel to the mounting points. The seam 50 may have for example, bushings or eyelets 1000 running through the seam as can best be seen in FIG. 19A. FIG. 12A shows a cross-section of the seam having the front and back portions 10, 20 folded together as described above. In alternate embodiments, the bushing 1000 may pass through only the back portion 20 of the panel 5. The bushing may be any suitable bushing having any suitable shape such as for example, round, square or oval. FIGS. 11B, 12C show the different mounting point configurations in accordance with other exemplary embodiments. In FIG. 12B, a post with a ring or catch may be positioned in the bushing. In the example shown in FIG. 12C, a hook fastener is mounted in the bushing. As may be realized, the hook or ring fasteners on the panel may engage suitable complementing fasteners on or structure of the base wall to attach the panels to the wall. Referring back to FIG. 11, the bushings 1000 may engage straps 1140, hooks, or any other suitable quick connect. Although two bushings 1000 are shown in FIG. 10, any suitable number of bushings 1000 may be used. The wall 510 may have suitable cutouts 1150 for receiving a strap 1140 or any other suitable quick connect such as a hook, hanger or clasp. In alternate embodiments the quick connects may be molded into or attached to the rapid deployment wall 510. In other alternate embodiments, the rapid deployment wall 510 may have suitable receivers for quick connects that have been molded into the seam 50 or back portion 20 of the panel 5. The panels 5 may also be placed and secured to the top of the wall 510 to further prevent damage to the internal wall structure.

In other exemplary embodiments, the panels 5B may have pop out or push out panels 2000 on the back side 20B of the panel 5B capable of attaching the panel as shown in FIG. 14A-14D. A single pop out panel 2000 is shown generally located in the center of the panel 5B, however any number of pop out panels 2000 may be located in any orientation on any side, top or bottom portion of panel 5B. In other embodiments the panel 5B may have pop out tabs, clips or any other device protruding from the panel 5B suitable for attaching the panel 5B. The rapid deployment wall 510B may have slots 1150B or other suitable cutouts for receiving the pop out panel 2000. In alternate embodiments the pop out panel 2000 may hang over the rapid deployment wall 510B. A slot 2001 capable of receiving the pop out panel 2000 may be located on the front side 10B of panel 5. Multiple panels 5 may be interlocked together and hung over or attached to the rapid deployment wall 510B as described above. In alternative embodiments the panel 5B' may be configured in a horizontal orientation. Moreover, panels 5B and 5B' may have multiple pop out panels 2000 and 2000' protruding from the back side 20B and 20B' respectively. Multiple panels 2000 and 2000' increase the rigidity of the panel mounting system.

In the exemplary embodiment shown in FIG. 5, the rapid deployment wall system 55' may have a rail or channel system for holding the panels 5 to the base wall 510'. The rail system may include vertical rails 500 and horizontal rails 505. The rails 500, 505 may be constructed of any suitable material capable of holding the panels 5 in place. The rails 500, 505 may have channels in which the panels 5 are fitted or slid into. For example, the horizontal rails may have a general "U" or "H" shape where the rail is attached to the wall 510 so that the panel 5 sits within a recess of the "U" or "H" shaped rail against the wall 510. In alternate embodiments, the horizontal rails may have a general angle or "T" shape. The horizontal rail 505 may be attached to the wall by quick connect mechanical fasteners such as for example, straps, clips or hooks. In alternate embodiments, any suitable quick connect fastener may be used to attach the horizontal rail 505 to the wall 500. In other alternate embodiments any suitable fastener may be used. The vertical rails 500 may have a general "T" cross-section as shown in FIG. 5, or a general "H" or angle cross-section (not shown). The vertical rails may be attached to the wall 510 in a manner substantially similar to that described above for the horizontal rail 505. The panels 5 may be slid into the channel formed by the vertical and horizontal rails 500, 505 from the top. In alternate embodiments, the panels 5 may be fit into the rails 500, 505 by any suitable method such as for example placing the panel 5 into the horizontal rail 505 and resting the panel against the wall. The vertical panels may be installed on the wall over the panels 5 to secure the panels in place. In other embodiments, the rails 500, 505 may be preinstalled on the rapid deployment wall 510. Sufficient panels 5 are positioned to cover the length of base wall 510'.

Figure 7:
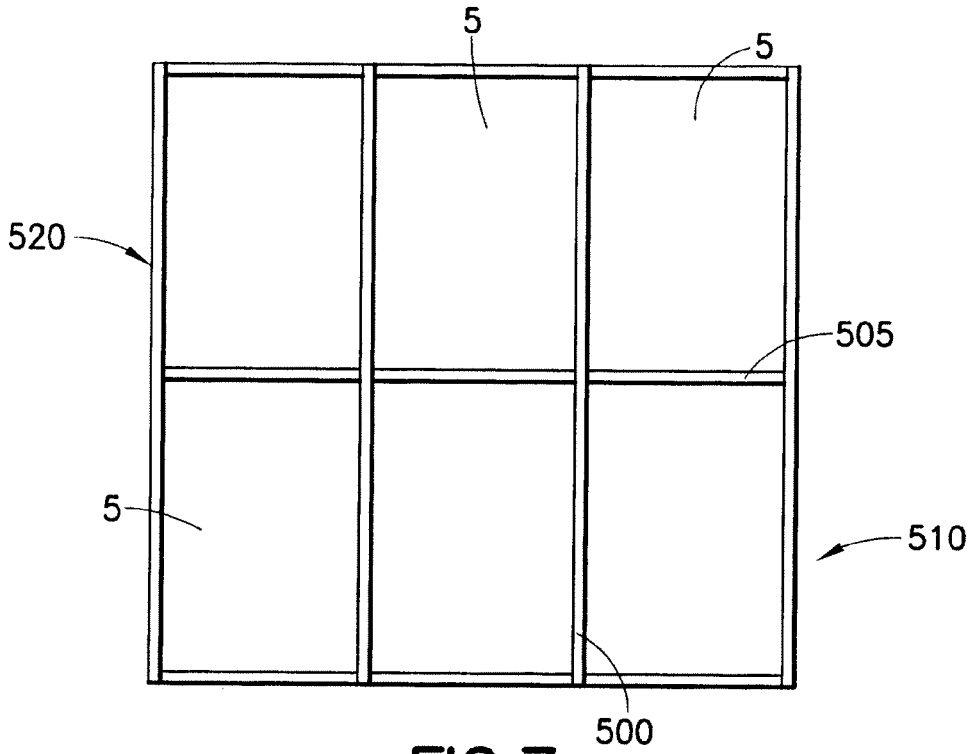
FIG. 7 shows the system in accordance with an exemplary embodiment.

As seen in FIG. 7, the support system, in the exemplary embodiment rails 500, 505 may be used to stack panels 5 above one another to cover the height of the base wall 510'. As may be realized barrier system 15 may be used without base wall 510' and applied directly to any other desired wall, structure. Hence, the system may be erected in a matrix arrangement similar to that shown in FIG. 7 to cover tall structures such as for example a multistory building or shelter. In the exemplary embodiment shown in FIG. 7, the rails 500, 505 form a grid in which the panels 5 are inserted. The panels and rails 500, 505 may be installed in rows. For example, the bottom row 510 may be installed in a manner substantially similar to that described above. The top row 520 may be installed above the bottom row 510 so that the bottom row 510 acts as a vertical support for the top row 520.

Figure 8A:
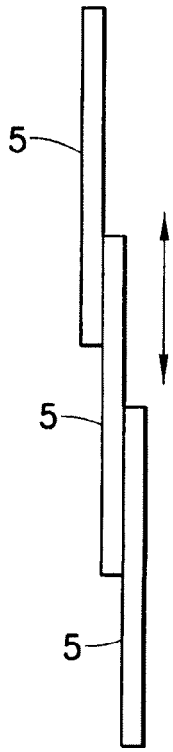
FIGS. 8A and 8B are side elevation views respectively showing the system in two different positions in accordance with an exemplary embodiment.
Figure 8B:
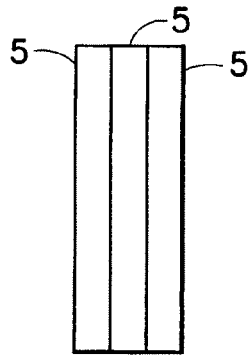

In other exemplary embodiments, the panels 5 may be held in slidingly installed rails or fixtures one capable of sliding the panels past one another as shown in FIGS. 8A and 8B. In alternate embodiments, the mounting system may hold the panels in any other desired movable arrangement such as an accordion arrangement. The panels 5 may be installed in rails, similar to rails 505, 500 positioned, for example, on a cable pulley system or any other suitable movable system so that the panels 5 may slidingly e-tend horizontally or vertically (as shown in FIG. 8A) and retract (as shown in FIG. 8B). Installing the panels in this manner may provide a curtain having the same protective capabilities as the panels lining the wall 510. In alternate embodiments, the slidingly engaged panels 5 may be mounted in other orientations The panels 5 may also be installed over the top of a structure to provide overhead protection. The panels 5 may be placed over the top of wall 510, or any other substantially flat top structure. If desired, the panels may be positively attached to the top of the structure. The panels may be supported by a roof of the structure or the walls of the structure in conjunction with the overhead grid system or any combination thereof.

Figure 9:
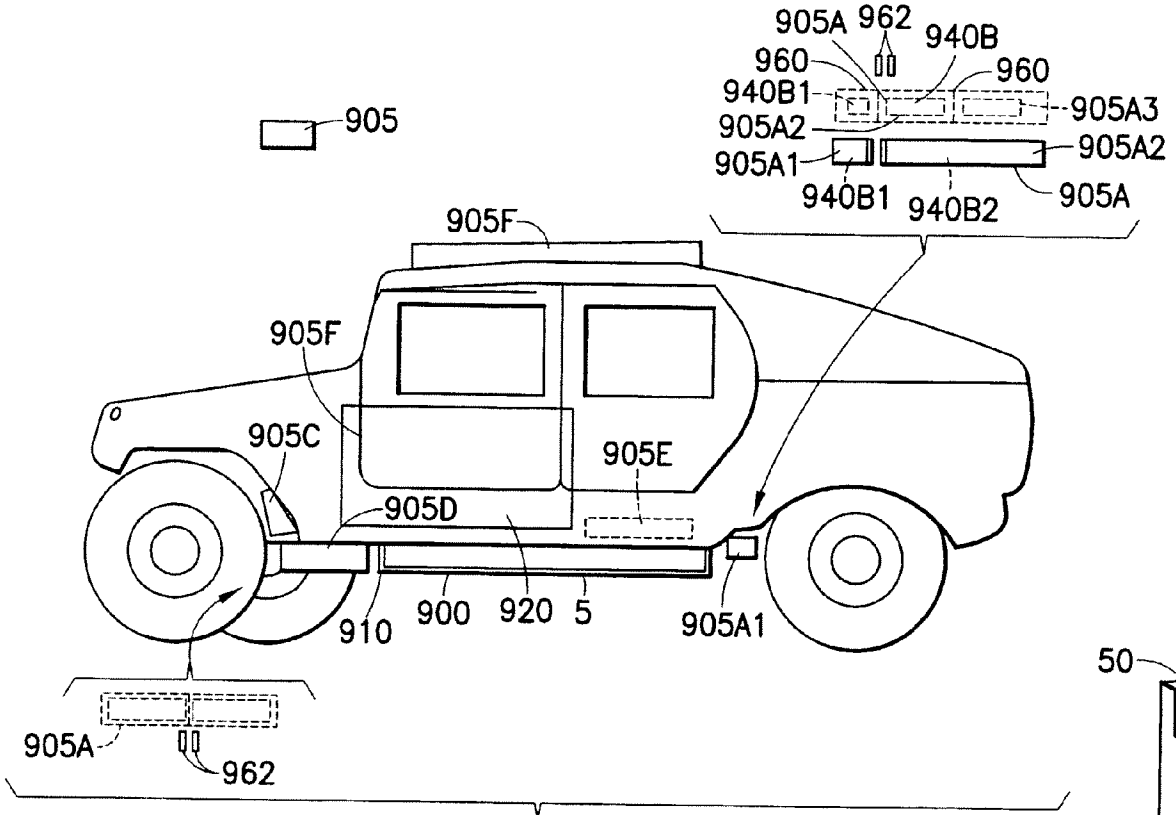
FIG. 9 shows a system in accordance with another exemplary embodiment and a vehicle on which the system is mounted.

FIG. 9 illustrates another exemplary embodiment, in which the panels 5 of barrier system 15 may be installed on a vehicle, for example the undercarriage or any other portion of a vehicle. Portions of the panels may be reinforced with metal plates 900 or any other suitable material that may prevent the panel from being damaged by abrasion or an impact from an object such as a rock or piece of debris. For example, the leading edge 910 of the panel 5 as shown in FIG. 9 may be reinforced. The reinforcing of the panel may be provided by a separate plate 900 that is affixed to the structure to which the panel is attached. In alternate embodiments, the reinforcing panel may be formed as a unitary feature (i.e. unitary construction) of the panel 5 itself. For example, the panel 900 may be inserted in between the layers of the fiberglass cloth or matting during the panel manufacturing process. In alternate embodiments, the panels 5 may be adapted for use on aircraft or water going vessels.

Figure 9A:
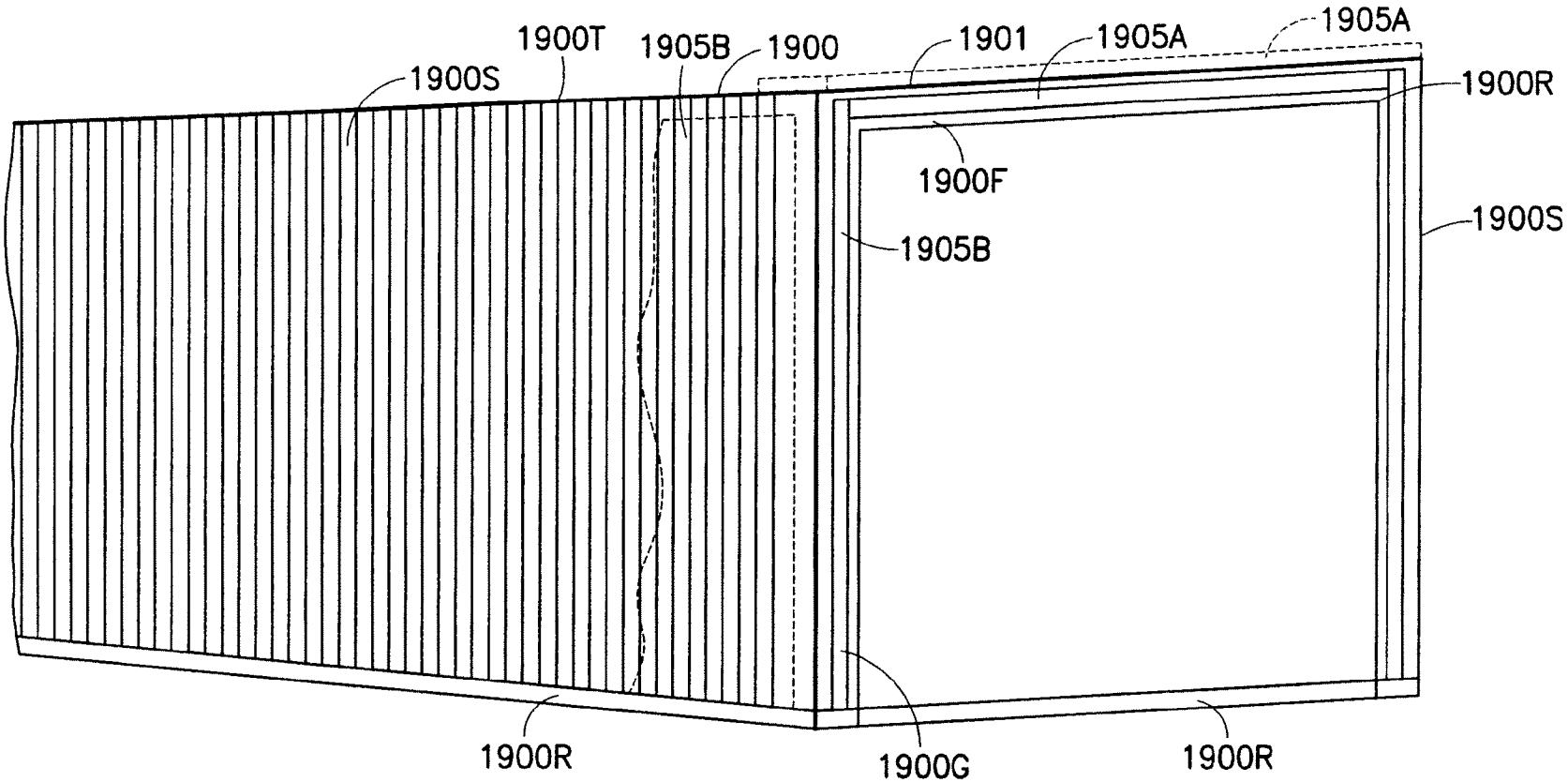
FIG. 9A shows a schematic perspective view of a system in accordance with yet another exemplary embodiment mated to a mobile structure.

Referring now to FIG. 9A, there is shown a schematic perspective view of a mobile structure with a barrier system according to another exemplary embodiment. In the exemplary embodiment shown, the mobile structure may be a container 1900, such as an ISO standard 20 ft or 40 ft shipping container. In alternate embodiments, the mobile structure may be of any suitable type and may have any desired shape. As seen in FIG. 9A, the shipping container in the exemplary embodiment, incorporates the barrier system 1901 within the structure of the container. The container 1900 may have a general box frame structure 1900F (for example conforming to ISO standards) that substantially frames the container space. The box frame may be formed from open or closed section rails 1900R. Panel walls, such as for example made of generally corrugated sheet metal, may be attached to the container frame to form the container sides 1900S, 1900T. The container sides may have a general sandwich arrangement with inner and outer wall panels and a void therebetween. In alternate embodiments, the container sides may be formed from a single wall panel that defines a recess or void when attached to the rails 1900R) (e.g. the panel may be connected to the inner base of the rail forming an exterior recess 1900G). In the exemplary embodiment, the modules 1905A, 1905B of the barrier system may be located into the voids and recesses formed by the container sides 1900S, 1900T. Also, modules 1905A, 1905B of the barrier system may be positioned on the exterior of the container sides 1900S, 1900T. During transport of the container, the barrier system may be positioned in stored locations, such as inside the container, for example to avoid damage to the barrier system prior to deployment. The barrier system modules 1905A, 1905B may be removed from storage, when desired, and installed in the deployed positions as shown in FIG. 9A. The modules 1905A, 1905B may be generally similar to modules 5, 51 described previously. The modules may be sized as desired. For example module height may be substantially equal to height or width of the container. Modules may be positioned on the container in any desired manner (see for example FIGS. 15A-15C.)

Referring back to FIG. 9 in accordance with another exemplary embodiment, the panel 5 may be provided in various sizes and shapes suitable for installation on any portion of a structure, such as a vehicle. A kit 905 of panels 905A-905F may be provided. The panels 905A-905F shown in FIG. 9 are merely exemplary and in alternate embodiments the kit 905 may have more or fewer panels. The panels 905A-905F in the kit are generally similar to panels 5, 5A, B described further herein. In the exemplary embodiment, the kit may have panels 905A-905F of different sizes and shape allowing the user to select desired panels from the kit to the support structure (e.g. vehicle). Hence, the user may select from the kit a desired panel sized and shaped to be better suited for installation on a given portion of the support structure (e.g. panel 905C inside the wheel well of a vehicle, panel 905F on an outer surf ace of the vehicle as shown in FIG. 9). The kit may include one or more panels 905A having a seam 960. The panels 905A may be divided into separate sub-sections (for example panel 905A may have seams 960 resulting in subpanel sections 905A1-905A3, see FIG. 9). The panel 905A may for example be parted along the seam to form independent subsections that may be configured into the various sizes and shapes that are installed on the support structure. The independent subsection panels 905A1-905A3 may be formed for example by separating the panel 905A along desired seam lines 960. In the exemplary embodiment shown in FIG. 9, the filler material 940B may be provided in packets (such as for example BLASTWRAP™) or packet array 500Bl with joints or seams in the packet array that is coincident with the panel seams T60. Accordingly, separation or sectioning of the panel 905A along the seams 960 will not rupture the filler material packets and hence will not result in undesired loss of filler material. The panel 905A may have marking indicia identifying the seam lines in the panel. The seams 960 in the panel casing may also be frangible in nature (for example formed by preformed serial perforations) allowing a user to subdivide and separate the panel along the seam 960 in the field without use of special cutting tools (e.g. the user may break the casing along the seam by fracturing the material between perforations with a sharp edged object or tool). The kit, in the exemplary embodiment shown in FIG. 9 may also include casing sections, such as intermediate caps 962 to close off the subsections 905A1-905A3 once formed. The panels may also be sectioned as shown in FIG. 1A. The panels 905A-905F and panel sub-sections 905A1-905A3 may also be placed anywhere inside the vehicle, for example the sub-sections may be placed under the seats of the vehicle to absorb energy coming through the floor of the vehicle. Placing the panel—subsections under the seat is only an example and the sub-chambers may be placed in any position or orientation in or on the vehicle. The panel 905A-905F and various subsections may also have an integral mount system for attaching the panel to the vehicle. The mount system may be integral ears 920 or any other suitable mounting system. The integral ears may be attached directly or indirectly to the supporting surface and a securing fastener may extend through the integral ears 920 to a supporting surface. Two integral ears 920 are shown; however any number of integral ears in any orientation may extend from the panel 905A-905F.

The ability for the system to fit within standardized shipping containers, the light weight of each panel 5, the ability for the panels to be erected and/or attached to a structural surface using quick connects and the preformed nature of the panel (i.e. the panel is ready to be used out of the box and doesn't have to be filled) contribute to the system's ability to be rapidly deployable. In addition, When barrier system 15 is installed on a wall or any other structural surface, the panels 5 of the protection system may protect that wall or surface and subsequently any personnel behind the wall or surface from a blast by reducing the blast impulse and pressure, including reflected pressure and impulse. The panels 5 may also quench fireballs and suppress blast fires. Lethal fragments that enter the panel may also be captured by the back portion 20 of the panel 5.

The frangible front portion 10 of the panel allows a blast and any associated fireball, fragments and/or pressure wave to enter the panel. The filler material 40 removes energy from impinging shock waves and suppresses shock reflections by dissipating blast energy through irreversible processes. The filler material 40 also quenches or rapidly cools impinging fireballs and hot explosion gases thus preventing the fireballs or hot gases from reaching the back portion 30 of the panel 5. The filler material may also interfere with secondary combustion for slower burning materials such as propellants, aluminized explosives and those that do not have enough oxidants and as a result reduces heat release and gas pressurization. The laminated fiberglass matting of the back portion 20 of the panel 5 may stop or contain any fragments that may result from a blast and distribute the impact forces resulting from the fragments over a larger area of the wall or structure thus preventing penetration of the wall or structure. In addition, due to the timing involved with a blast wave acting on the panel 5 (e.g. milliseconds) the panel's rear portion 20 and the wall may act substantially as one unit. As such, the back portion 20 of the panel may increase the strength of the wall and prevent fracturing of the wall, such as in the case of concrete structures, or dispersal of wall material due to any direct or reflected pressure/shock waves that have passed through the filler material 40 and into the wall.

Figure 13:
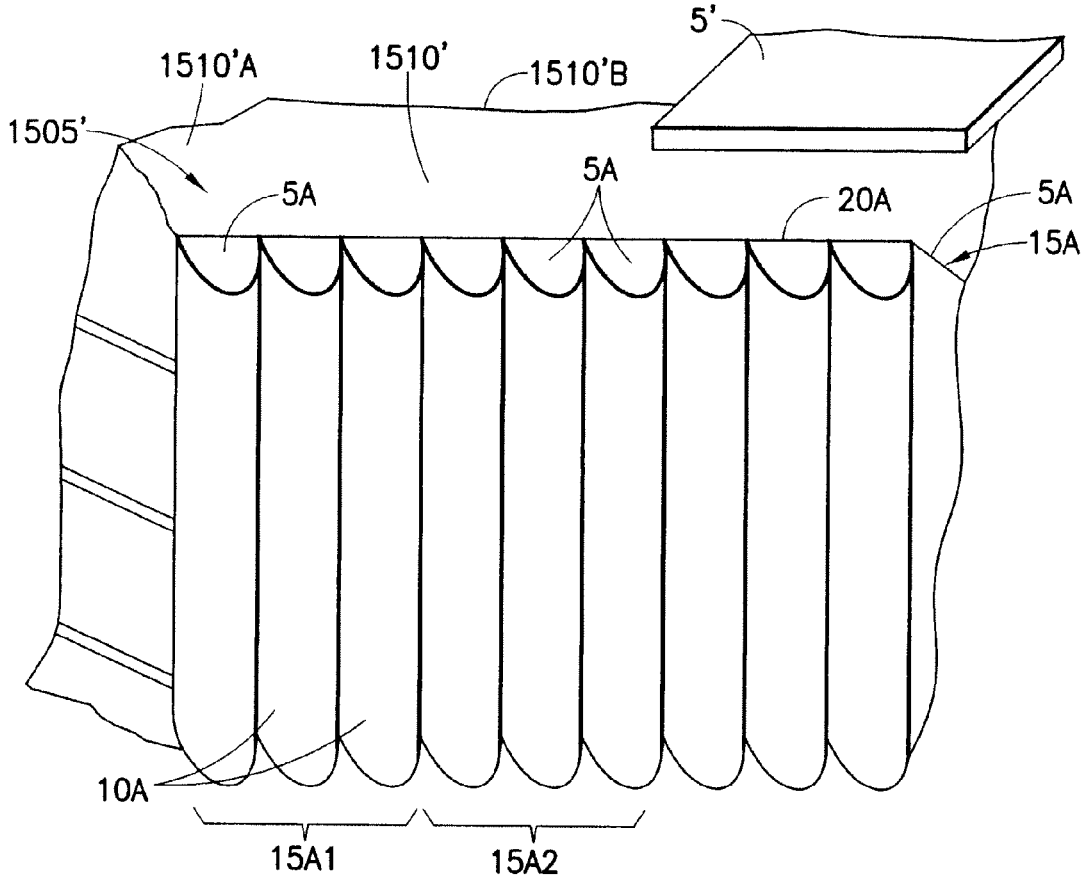
FIG. 13 is a partial perspective view of a system in accordance with an exemplary embodiment.
Figure 13D:
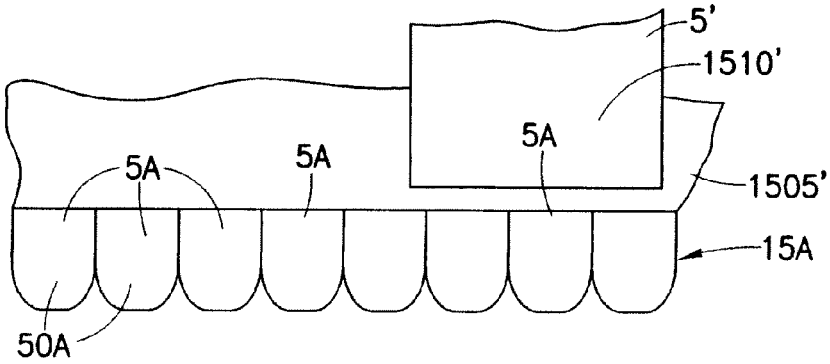
FIG. 13D is a top plan view of the system in accordance with another exemplary embodiment.

Referring now to FIGS. 13 and 13D, there is shown respectively schematic perspective and top plan views of a rapid deployment structural system 1505' in accordance with another exemplary embodiment. The rapid deployment structural system 1505' in FIG. 13 is generally similar to structural system 505' described before and shown in FIG. 5, except as otherwise noted. Similar features are similarly numbered. Similar to system 505', the rapid deployment structural system 1505' also generally comprises a base structure 1510' and a barrier system 15A connected to the base structure. The base structure 1510' is illustrated in FIG. 13 as a wall, though in alternate embodiments the base structure may be any desired type of structure including for example portions of buildings (e.g. walls, roofs, etc.), portions of civil infrastructure such as retaining walls, water, oil, sewer, electrical pipes and conduit structure (whether vertically or horizontally oriented or at some angle in between), or vehicle structure. A suitable example of a base structure 1510' is the "rapid deployment fortification wall" system available from Geocell Systems, Inc. The Geocell wall system has a collapsable/expandable space frame or grid sections. The space frame may be collapsed for storage and transport. As seen in FIG. 13, the base structure may be formed from sections 1510A', 1510B'-1510I' that may be portable. The wall sections may be sized as desired for stable storage and shipment in standard storage containers. In alternate embodiments, the base structure sections may not be collapsible (e.g. sections may be rigid or semi-rigid) and may be portable or movable in substantially the same configuration in which they are installed. As may be realized, the collapsible space frame sections may be expanded in order to be positioned to form the support structure. The expanded space frame sections may form voids that may be filled with any suitable material, such as dirt, sand, etc. In alternate embodiments, the voids in the expanded space frame may not be filled (or a portion of voids may be filled) and the support structure may be formed from stacked unfilled support sections. The support sections may be stacked horizontally to form a support structure of desired length and vertically to form a support structure of desired height. Moreover, the support structure sections may be joined to form a span structure (not shown) capable of spanning over a gap between founding supports under and supporting the span structure.

Figure 13A:
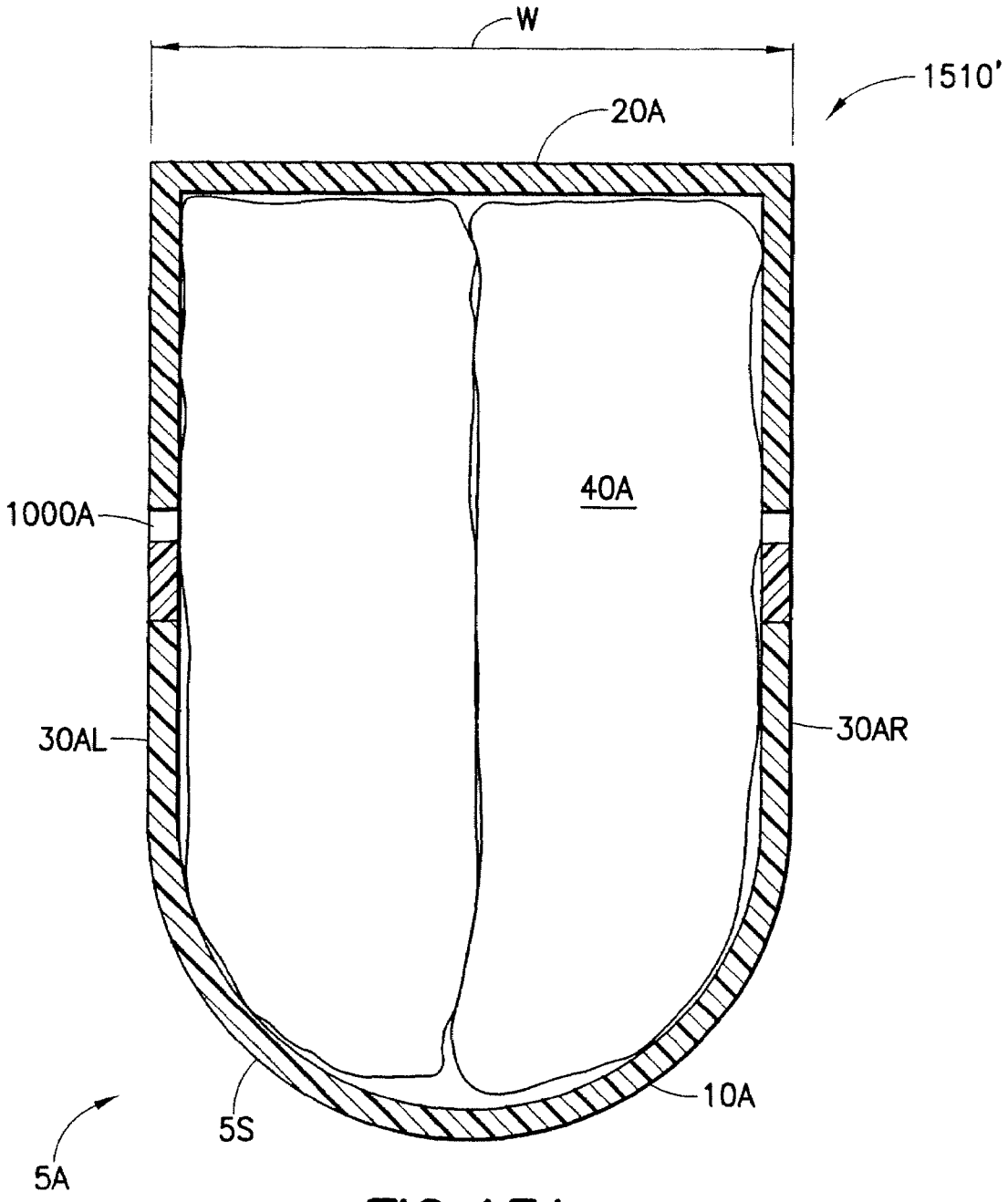
FIGS. 13A-13C are a cross-sectional view, and left and right side elevation views respectively showing the system in accordance with yet another exemplary embodiment.
Figure 13B:
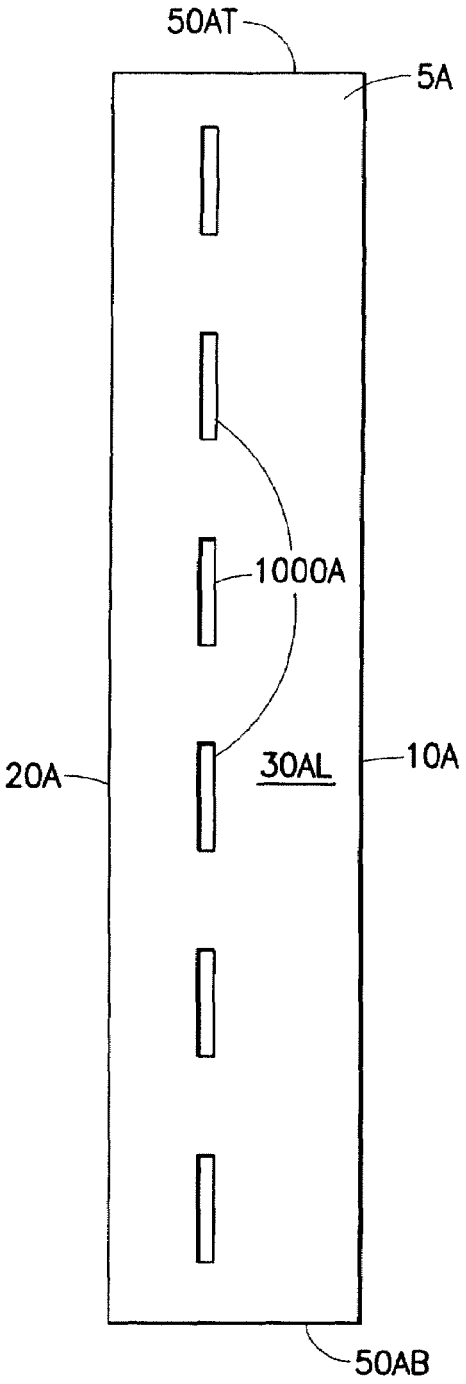
Figure 13C:
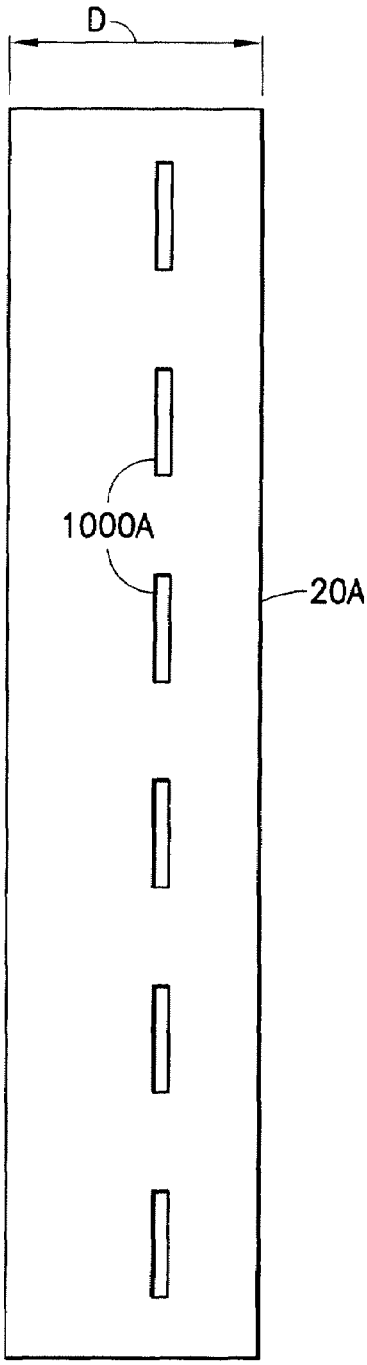

As noted before, the barrier system 15A is connected to the support structure 5A. In the exemplary embodiment shown in FIG. 13, the barrier system 15A may have barrier sections 5A and barrier panels 5'. Barrier panels 5' may be substantially the same as panels 5 described before and shown in FIGS. 1 and 3-4B. Except as otherwise noted below, barrier sections 5A also are similar to panels 5 and similar features are similarly numbered. Sections 5A are exemplary of yet another shape in which panels 5 may be formed. Referring now to FIGS. 13A, 13B, 13C there is respectively shown a cross-sectional view, and left and right side elevation views of a representative barrier section 5A in accordance with the exemplary embodiment. Similar to panel 5, barrier section 5A has an outer shell 5S that encapsulates an energy absorbing or attenuating material. The shell 5S is generally similar to the shell of panel 5. Shell 5S generally has a front 10A and back portion 20A that are joined by side portions 30AL, 30AR. The top and bottom of the shell 5S may be closed by portions 50AT, 50AB as will be described below. Front and back portions 10A, 20A are made from materials that are respectively similar to the materials used to form corresponding front and back portion 10, 20 of panel 5. For example, front portion 10A is frangible and may be made of any suitable material such as fiberglass, or ceramic, glass, plastic, polyethylene, polyvinyl chloride or any other suitable material. The back portion 20A is fracture resistance with anti-ballistic capability made from any suitable material, such as the Rapid Mat™ reinforced mats available from Colt RapidMat LLC as described before. The side portions may be from similar material(s) to the front portion 10A, or back portion 20A or any other suitable materials as will be described below. The top and bottom closures (see FIG. 13B) may be made from similar materials to the sides 30AL, 30AR, or from any other suitable material such as fiberglass, ceramic, plastic etc. The energy absorbing or attenuating material 40A inside the shell 5S of the barrier section 5A may be similar to filler material 40 in barrier panels 5 described before. For example, material 40A may be BLASTWRAP™ as available from Blastguard® International, or any other suitable material. In the exemplary embodiment, the filler material may have a generally granular structure and as such may be encapsulated in an easily renderable membrane or sheeting to form filler material packages of desired size and shape to facilitate placement of the filler material in the shell 5S. In the embodiment shown in FIG. 13A, two filler material packages 40A are shown for example purposes, and in alternate embodiments the filler material inside the shell may be disposed in any desired number of packages. The placement of the filler material packages inside the shell shown in FIG. 13A is exemplary, and in alternate embodiments packages of filler material may be placed so that interfaces between packages may be positioned and oriented as desired inside the shell of the barrier section. As may be realized, the filler material 40A substantially fills the interior of the shell. In alternate embodiments, the filler material may be placed in loose form inside the shell. In other, alternate embodiments the energy absorbing or attenuating may be included in a support and distribution matrix, such as a gel or foam that is placed in the interior of the barrier section shell.

As seen best in FIG. 13A, the barrier section shell 5S in this exemplary embodiment may have a cross-sectional profile in which the section front-back depth D (see also FIG. 13C) may be greater than the side to side width W of the section. In the exemplary embodiment the W/D ratio is about 0.6. Thus for example, for a given section width W (e.g. about 6") the section depth d is about 66% greater than the width of the section (e.g. about 10"). This results in the positioning of more filler material in depth (i.e. the direction in which energy, such as blast and heat effects are directed towards and act on the barrier section and its filler material). In an alternative embodiment, the shell 5S may have a cross-sectional profile in which the section front-back depth D may be equal to the side to side width W of the section. In this alternative embodiment the W/D ration is about 1.0. In alternate embodiments, the width to depth ratio W/D of the barrier section may be varied as desired to provide desired depth of filler material in the direction in which energy is applied to the barrier section. As also seen best in FIG. 13A, the front section 10A of the barrier section shell in this embodiment may be rounded or curved outwards. The curvature of the front section may be of substantially uniform radius between sides 30AL, 30AR (for example in the case W is about 6.0", a radius of about 3.0" may be used for the front section thereby forming a generally semi-circular section). In alternate embodiments, the curvature of the front portion may be flattened or sharpened as desired resulting in a generally semi-elliptical cross-sectional shape of the front portion 10A of the barrier section. As may be realized, the curved front section 10A presents an increased front surface of the barrier section for the given width W of the barrier section. The increased front surface of the front portion of the barrier section may assist in directing more energy into the barrier section to be absorbed or attenuated by the filler material inside the barrier section. The improved structural properties of the front portion, arising from the curved geometry, relative to a flat front, may reduce susceptibility to incidental damage to the front portion that may occur. The thickness of the material of the front portion may be set as desired to ensure the front section remains frangible for desired effects when subjected to energy bursts. The back portion 20A of the barrier section is shown flat for example purposes, but in alternate embodiments, may be formed in any desired shape generally conformal to the surface of the base structure 1510'. This allows the barrier section 5A to be placed with the back 20A in close contact with the surface of the base structure along the length of the barrier section. In the exemplary embodiments, the panel length is substantially the same as the height of the base structure (for example about 4'). Thus, base structure sections and barrier sections of substantially matching dimensions may be provided as a general kit, to facilitate erection of the rapid deployment structural system 1505'. In the exemplary embodiment, the side portions 30AL, 30AR are substantially flat, though in alternate embodiments the side portions may have any desired shape such as to provide lap fits (see for example FIG. 6) between adjacent panels.

Referring again to FIGS. 13B-13C, the barrier sections 5A in this exemplary embodiment may be provided with integral attachment system 1000A for attaching the barrier sections to the base structure and to each other if desired. In alternate embodiments, the barrier sections may be placed without any attachment against the base structure as shown in FIG. 13. The barrier sections may rest on end against the ground, or other foundation. In the exemplary embodiment, the integral attachment system 1000A may be sufficient to carry the weight of the barrier section. In the embodiment shown in FIGS. 13B-13C, the attachment system comprises a number of slots or apertures formed into the sides 30AL, 30AR of the shell 5S. The slots may be distributed equally along the length of the barrier sections. The number of slots shown in the figures is exemplary and any desired number may be used. The left and right sides are similar but opposite hand. The slots may have a configuration generally similar to eyelet 1000 shown in FIG. 12A. In alternate embodiments, the attachment system may be located in the back portion of the shell. The slots of the attachment system allow insertion of catches or hooks (not shown) secured for example to the base structure, and form engagement surfaces for the catches to effect attachment of the barrier section to the base structure. By way of example, the catches may engage the top of the slot so that the shell material rests on and is held by the catch which is in turn supported by the base structure. The catches may be secured to the base structure in any desired manner. By way of example, the catches may be formed or corrected to be integral to the expandable space frame/grid sections of the base structure 1510'. The catches may extend forward from the base structure 1510', along the sides of the barrier section to engage the slots of the attachment system 1000A. In alternate embodiments, any other suitable attachment or mounting system may be used, such as support sections similar to "H" or angle sections 505,500 shown in FIG. 5 and described before.

The barrier sections 5A may be formed in a substantially similar manner to panels 5 described before. The shell 5S of the barrier section may be molded, using a mold of desired shape conforming to the final desired shape of the shell. By way of example, for the generally "D" shaped shell (see FIG. 10A) a generally "D" shaped mold (not shown) may be used. The mold may otherwise be similar to mold 300 described before and shown in FIG. 3. The application of the materials, to form the front, back and side portions of the shell 5S, on the mold may also be similar to that described before. For example layers of fiberglass material, for front portion 10A, or of the aramid reinforced fiberglass Rapid Mat™ material, for back portion 20A, may be placed on the mold and resin applied over the material layers. The material layers respectively of the front and back portions may be extended along the sides and lapped if desired to form sides 30AL, 30AR of the shell. In alternate embodiments, the front portion, side portions, and back portion may be formed independently and joined by laminating material in order to form the shell. When complete, the shells are filled with the filler material 40A described before and the ends are closed by laminating closures 50AT, 50AB (see FIG. 13B) top and bottom.

The barrier section 5A may be arranged in group 15A, 15A2 to correspond to sections 1510A', 1510B' of the base structure. Thus, for a given section of base structure, there may be a group of barrier sections 5A associated therewith. For example, for a section 1510A' having a length corresponding to three barrier sections, placed side by side as shown in FIGS. 13-13D, there may be a group 15A1 of three barrier sections associated therewith. The base structure sections and associated group of barrier sections 5A may be packaged together so that when the base structure section is deployed and erected, by itself or part of a larger base structure, the group 15A1 of barrier sections associated therewith is available at the erection site and may be positioned into contact with the base structure section as shown in FIG. 13. When erected, base structure and barrier sections may operate substantially as a unit when subject to blasts. As seen in FIG. 13D, the system may also use panels 5 that are placed on spanning or overhanging grip work to provide energy absorption or attenuation against overhead blasts.

Figure 14A:
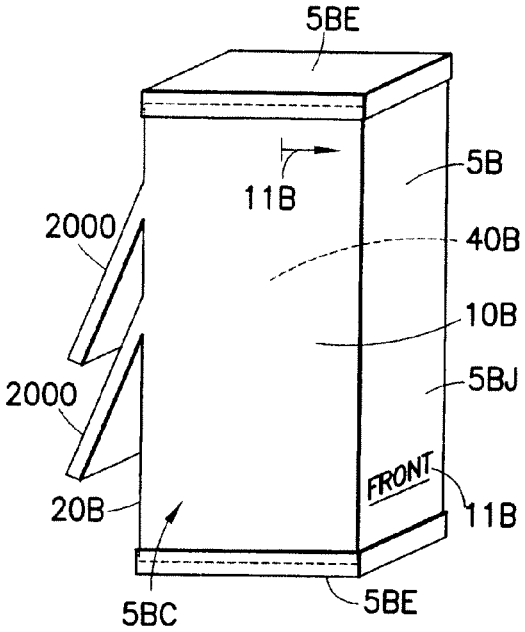
FIGS. 14A-14D are a side, rear and rear view respectively of yet another exemplary embodiment.
Figure 14B:
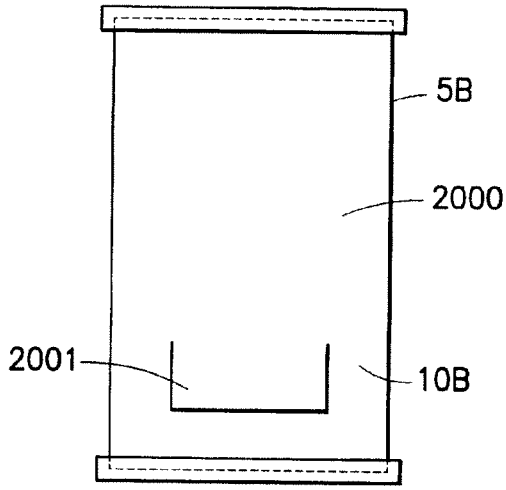
Figure 14C:
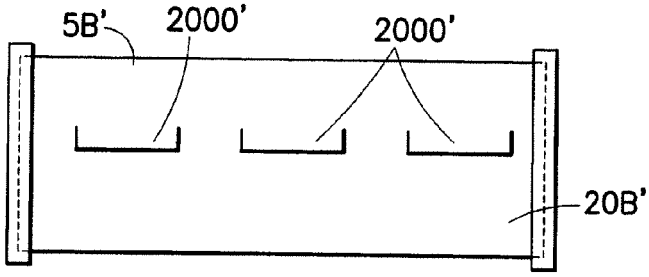
Figure 14D:
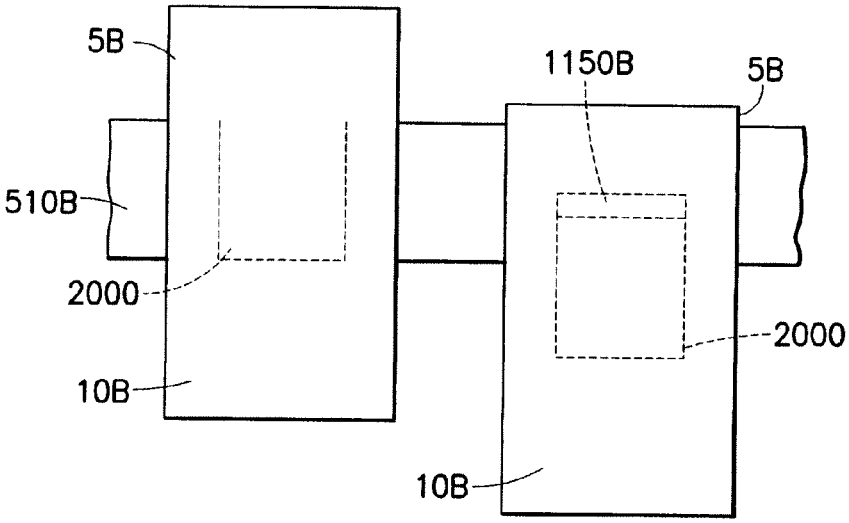

Referring now to FIG. 14A there is shown yet another schematic perspective view of an energy absorbing panel or module 5B of the barrier system in accordance with another exemplary embodiment. The panel 5B is portable (for example capable of being hand carried) and generally similar to the barrier system panels 5, 5A described previously, except as otherwise noted below, and similar features are similarly numbered. Panel 5B generally has a casing or shell 5BC that is substantially rigid. The casing may be filled with suitable energy absorbing or attenuating material 40B such as for example one or more layers of the BLASTWRAP™ material packages from BLASTGUARD® International. In the exemplary embodiment illustrated in FIG. 14A, the panel casing has a representative shape (e.g. generally hexahedron) though, and as has been noted before, alternate embodiments, the panel casing 5BC may have any desired shape. In the exemplary embodiment the casing 5BC may be made of plastic, such as a thermosetting or thermoplastic polymer, or any other suitable plastic resulting in the casing sides being frangible. In alternate embodiments the casing may be made of any other suitable material including suitable metallic materials. In the exemplary embodiment, the casing 5BC may include a tubular section 5BJ and end caps 5BE. The tubular section 5BJ in the exemplary embodiment may be formed by extrusion and may be of unitary construction (i.e. a one piece member). In alternate embodiments, the tube portion of the casing may be formed with any other fabrication process and may comprise sections joined together with any desired means. In the exemplary embodiment shown in FIG. 14A, the lateral sides of the tube section 5BJ may be substantially of equal width (for example about 6.5 inch width) though as will be described further below the casing and the panel 5B may have a predetermined orientation or installation polarity. If desired, the corners of adjoining panels may be generally rounded, for example with a radius of about ⅜ inch. In the exemplary embodiment, the end caps 5BE, which may for example be made of similar material to the tube section (though in alternate embodiments the end caps and tube may be made of different materials) may be generally conformal to the tube section allowing the end caps 5BE to be placed over to close the ends of the tube section 5BJ. In alternate embodiments, the end caps may have any other suitable configuration and may be mated in any other desirable manner to close the casing, and in yet other alternate embodiments the casing may have any other suitable structure formed in any other suitable way.

As seen in FIG. 14A, the casing may have an integral mounting system 2000 (described previously) formed or located in one side of the casing. As may be realized, the integral mounting system 2000 of the panel 5B, may provide the panel 5B in the exemplary embodiment with a predetermined installation polarity so that when installed in the barrier system, as described further herein, the panel 5B may be positioned with a predetermined side (for example a side, opposite the mounting system, named front for example) facing in a desired direction (for example facing the direction of energy wave propagation indicated by arrow E in FIG. 1). Indicia markings 11B may be provided on the casing to indicate the installation polarity, (the indicia markings in the figures are merely exemplary) In alternate embodiments, the casing may have the integral mounting system on more or fewer sides. The energy absorbing filler material 40B may be installed inside the tube section 5BJ in a similar manner to that shown in FIG. 13A. In alternate embodiments, the filler material may be installed in any other manner. The filler material 40B disposed in the casing, may also have a predetermined facing or orientation (for example the skin of the BLASTWRAP™ packets or wrapping may have a face of thin and easily rupturable material and a stronger back providing structural strength—to the packet or packet array). In the exemplary embodiment, the filler material 40B has a predetermined orientation that corresponds to the predetermined orientation of the casing 5B (e.g. the BLASTWRAP™ is positioned so the thin side is facing the FRONT of the casing, see FIG. 14A). As described before, the mounting system 2000 in the exemplary embodiment allows mounting of the panel 5B to supporting structure (for example structure 510B in FIG. 14D) in substantially on step (e.g. sliding attachment tab over the structure to hook the panel to the structure). Removal of the panel from the structure, as may be realized, may also be performed in substantially one step (e.g. lifting the panel to disengage the tab 2000 from the structure).

Figure 15A:
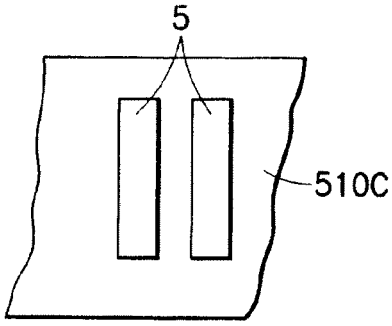
FIGS. 15A-15C show different configurations in accordance with yet another exemplary embodiment.
Figure 15B:
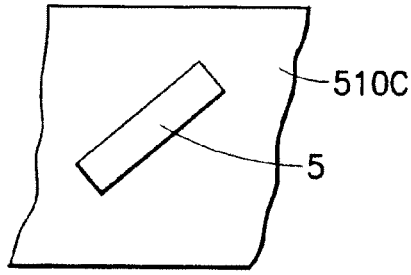
Figure 15C:
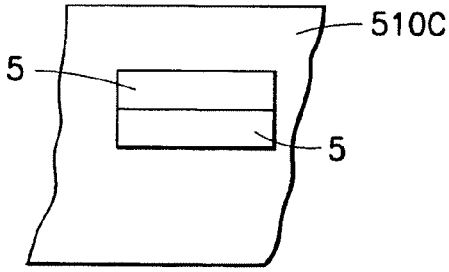

Referring now to FIGS. 15A-15C, there are shown different panel 5 mounting orientations in accordance with another exemplary embodiment. Panel 5 may be attached to support system 510C in any desired orientation, for example the orientation may be vertical, horizontal or diagonal with respect to the support system 510C. As seen in FIGS. 15A and 15C, the panel 5 may be separated from or grouped with additional panels 5 that are attached to the support system 510C to provide for effective energy dissipation or a barrier to the support structure. The panels 5 may be positioned singly or grouped in any desired area of the structure where an effective energy barrier is sought. The panels 5 may be oriented in the direct path of the energy release. Alternatively, the panel 5 is an effective barrier if the panel 5 orientation is offset from the direct path of the energy release. The panel may be attached to any suitable support system 510C, for example a support system may be a building wall, door, bridge piling or any other support structure in which energy dissipation is required.

Figure 16:
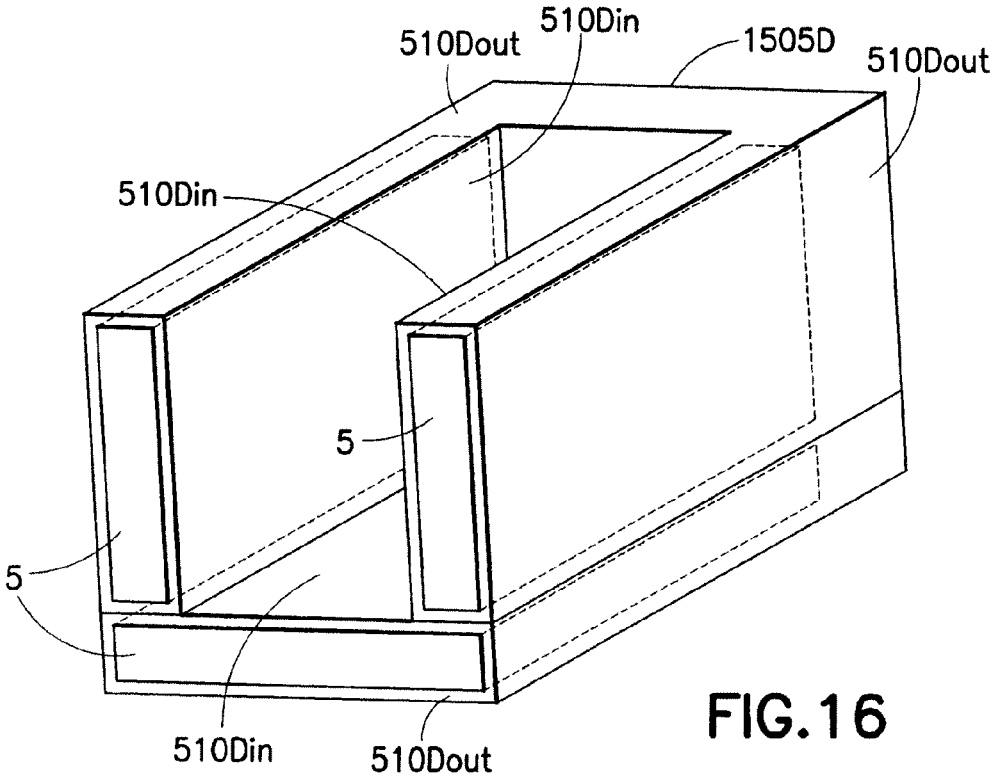
FIG. 16 is a perspective view of a system in accordance with still another exemplary embodiment and a container in which the system is mounted.

Referring now to FIG. 16, there is shown a perspective view of a structural system 1505D in accordance with another exemplary embodiment, in which the panel 5 is sandwiched between an inner support wall 510Din and an outer support wall 510Dout. The support walls 510Din and 510Dout may be constructed of metal, plastic or any other suitable structural material. The structural system 1505D may be a shipping container or any other container.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A modular energy barrier system comprising:

at least one energy barrier module comprising:

a substantially rigid casing having at least one frangible side;

an energy absorbing filler material disposed within the casing, the filler material being encapsulated in at least one filler material package where the at least one filler material package includes a plurality of individually sealed packages and an array of connected packages; and the casing comprising an elongated casing portion having a closed shell section defining a chamber for the energy absorbing filler material, the elongated casing portion being of unitary construction;

wherein the casing is adapted to be connected to a base support so that the at least one module is interposed between the base structure and an energy source and the at least one frangible side of the casing is oriented to face energy released by the energy source.

2. The system according to claim 1, wherein the casing has more than one side that is frangible.

3. The system according to claim 1, wherein the filler material has a predetermined orientation within the casing relative to the at least one frangible side.

4. The system according to claim 1, wherein the casing is a plastic extrusion.

5. The system according to claim 1, wherein the base support is at least one of a rapid deployment beam, vehicle, building wall, shipping container and bridge pilings.

* * * * *